US006588843B1

(12) United States Patent
Ebenstein

(10) Patent No.: US 6,588,843 B1
(45) Date of Patent: Jul. 8, 2003

(54) CHAIR CONTROL

(75) Inventor: Scott M. Ebenstein, Rockford, MI (US)

(73) Assignee: GHSP, Incorporated, Grand Haven, MI (US)

( * ) Notice: Subject to any disclaimer, the term of this patent is extended or adjusted under 35 U.S.C. 154(b) by 0 days.

(21) Appl. No.: 09/680,778

(22) Filed: Oct. 6, 2000

(51) Int. Cl.[7] ..... A47C 1/024; A47C 1/038

(52) U.S. Cl. ..... 297/300.1; 297/300.2; 297/300.4; 297/300.8; 297/301.1; 297/301.4; 297/302.1; 297/302.7; 297/303.1; 297/303.4

(58) Field of Search ..... 297/300.1, 300.2, 297/300.4, 301.1, 301.3, 301.4, 302.1, 302.7, 303.1, 303.4

(56) References Cited

U.S. PATENT DOCUMENTS

| | | | | | |
|---|---|---|---|---|---|
| 4,411,469 | A | | 10/1983 | Drabert | 297/300.2 |
| 5,286,088 | A | * | 2/1994 | Taylor et al. | 297/301.1 X |
| 5,423,594 | A | | 6/1995 | Hancock | 297/300.2 |
| 5,664,834 | A | | 9/1997 | Hsu | 297/300.1 |
| 5,725,277 | A | * | 3/1998 | Knoblock | 297/300.4 |
| 5,765,914 | A | * | 6/1998 | Britain et al. | 297/300.4 |
| 5,772,282 | A | * | 6/1998 | Stumpf et al. | 297/302.3 |
| 5,782,536 | A | * | 7/1998 | Heidmann et al. | 297/301.1 X |
| 5,810,439 | A | * | 9/1998 | Roslund, Jr. | 297/300.2 X |
| 5,909,924 | A | * | 6/1999 | Roslund, Jr. | 297/300.4 |
| 5,931,531 | A | * | 8/1999 | Assmann | 297/300.2 X |
| 5,934,758 | A | * | 8/1999 | Ritch et al. | 297/300.2 X |
| 6,015,187 | A | * | 1/2000 | Roslund, Jr. et al. | 297/300.4 |
| 6,120,096 | A | * | 9/2000 | Miotto | 297/300.1 X |
| 6,139,103 | A | * | 10/2000 | Hybarger et al. | 297/300.2 X |
| 6,250,715 | B1 | * | 6/2001 | Caruso et al. | 297/300.2 X |
| 6,273,506 | B1 | * | 8/2001 | Niergarth et al. | 297/300.4 |
| 6,286,900 | B1 | * | 9/2001 | Roark | 297/300.8 |
| 6,367,876 | B2 | * | 4/2002 | Caruso et al. | 297/300.2 |
| 6,386,634 | B1 | * | 5/2002 | Stumpf et al. | 297/300.2 X |
| 6,425,633 | B1 | * | 7/2002 | Wilkerson et al. | 297/300.2 |
| 6,450,577 | B1 | * | 9/2002 | Roslund, Jr. | 297/300.4 X |
| 2001/0000939 | A1 | * | 5/2001 | Roslund, Jr. et al. | 297/300.4 X |
| 2002/0113475 | A1 | * | 8/2002 | Ehr et al. | 297/300.4 |
| 2003/0034680 | A1 | * | 2/2003 | Stumpf et al. | 297/300.2 |
| 2003/0034681 | A1 | * | 2/2003 | Stumpf et al. | 297/300.2 |

FOREIGN PATENT DOCUMENTS

| | | |
|---|---|---|
| EP | 0698358 | 2/1996 |
| EP | 0934716 | 8/1999 |
| GB | 2108575 | 5/1983 |
| GB | 2264862 | 9/1993 |
| GB | 2352169 | 1/2001 |

* cited by examiner

*Primary Examiner*—Rodney B. White
(74) *Attorney, Agent, or Firm*—Warner Norcross & Judd LLP

(57) ABSTRACT

A chair control providing both articulating tilt motion and dual-ratio, adjustable, synchronized tilt motion. In a first aspect, the control can be configured as either an articulating tilt control or a synchronized tilt control. In a second aspect, the angle between the seat and the backrest may be selected by the user when the control is configured for either the articulating mode or the synchronized mode. In a third aspect, when in the synchronized mode, the angle between the seat and the backrest increases during forward tilt action to avoid "clam shelling." In a fourth aspect, a forward tilt selector enables or prohibits forward tilting of the control.

55 Claims, 17 Drawing Sheets

CHAIR CONTROL

BACKGROUND OF THE INVENTION

The present invention relates to office chairs, and more particularly to tiltable office chairs that provide ergonomic seating positions for a user.

Conventional office chairs are configured to allow tilting of the seat and backrest in either an articulating manner or a synchronized tilt controlled manner. With articulating chair controls, or "fixed-tilt" controls, the seat and backrest tilt as a unit with the seat and backrest at all times remaining at a predetermined angle. With synchronized tilt, or "synchro-tilt" controls, the seat and backrest tilt, but at varying rates. For example, the backrest may tilt backward, or recline, at a rate twice the rate of the seat. Put another way, for every one degree the seat tilts, the backrest tilts two degrees. While synchro-tilt control chairs provide a more ergonomically correct tilting action, many municipalities, including the city of New York, require articulating control features so that the user may set the angle of the seat with respect to the backrest at a predetermined angle specific to the user. As a practical matter, a manufacturer is required to produce and inventory both the articulating and synchro-tilt chairs. Accordingly, given the typical lag time between production and sale, manufacturers may be stuck with an excessive supply of one type of chair and a deficiency of another, depending on consumers' demand.

Articulating chair controls also allow the user to select the angle between the seat and back; however, after selection, that angle does not change when the chair tilts. With synchro-tilt controls, the relationship between the seat and backrest, as well as the rate of tilt of the seat with respect to the backrest, is predetermined by the design of the control. For example, in the upright position, the angle between the seat and backrest is fixed. As the seat and backrest tilt to a reclined position, the angle between the seat and backrest becomes larger than the angle between the seat and the backrest in the upright position, but the angle remains pre-determined by the design of the control. Thus, with both articulating and synchro-tilt controls, the angle between the seat and the backrest is limited to a single angular relation when the chair reclines or forward tilts.

Conventional office chairs are also provided with a forward tilt feature. This feature allows the user to either control the seat so that it does not tilt forward past the upright position, or, alternatively, control the seat to tilt forward past the upright position. In the forward tilt position, the pressure of the forward edge of the seat acting on the underside of a user's leg is reduced while the feet of the user may remain flat on the floor in a comfortable stance. Conventional chairs come either with or without the forward tilt feature from the manufacturer. Accordingly, a distributor must produce and inventory chairs with and without the forward tilt feature. This can make ordering and inventory management difficult.

With conventional synchro-tilt control chairs, when the backrest and seat recline from the upright position, the angle between the seat and the backrest becomes larger. As noted above, the angle between the seat and the backrest increases at about a 2:1 ratio with respect to the angle of the seat to horizontal. Further, when the seat and backrest are tilted forward from the upright position, the angle between the seat and the back closes at the same 2:1 ratio. Accordingly, the user will typically find herself being "clam-shelled" between the seat and the backrest because the backrest is tilting forward at a rate greater than the forward tilting of the seat. This causes the user unnecessary discomfort and a potentially ergonomically incorrect position.

SUMMARY OF THE INVENTION

The aforementioned problems are overcome by the present invention wherein a chair tilt control is convertible between an articulating chair control and a synchro-tilt control, provides adjustment of the angle between a seat and backrest in synchro-tilt mode, is convertible between forward tilt and non-forward tilt; and provides a first rate of when the chair is reclined and a second rate when the chair is tilted forward.

In a first aspect of the invention, the chair control is convertible between an articulating, or "fixed," tilt control or a synchro-tilt control. A chair manufacturer or distributor can convert the chair from one configuration to the other by simply configuring a lock mechanism in one of two positions. In the preferred embodiment, the control includes a housing—part of the chair base—which is pivotally attached to the seat. The backrest is pivotally attached to the seat. At a second pivot point on the backrest back lock mechanism, which is generally a mechanism of adjustable length, is attached to the backrest. One end of the bar is pivotally connected to the backrest. The other end of the bar may be attached to either a point on the seat or a point on the housing. If the bar is attached to the seat, the angle between the seat and the backrest does not change when the user reclines, thus attaining an articulating control. If the back lock bar is attached to the housing, the angle between the seat and back opens as the seat reclines, thus attaining a synchro-tilt control.

In a second aspect of the invention, the control enables the user to select the angle between the seat and the backrest even when the control is configured for synchro-tilt action. In the preferred embodiment, the adjustable synchro-tilt feature is incorporated into the above-described back lock mechanism. As noted above, the back lock is a bar of adjustable length. As a result of adjusting the length between the two points of connection of the back lock bar with the seat and the housing, the angle of the backrest changes in relation to the seat. Accordingly, a user may preselect the angular relationship between the seat and backrest of a synchro-tilt controlled chair as easily as a user may preselect the angle in the articulating control chairs of the prior art.

In a third aspect of the invention, an office chair includes a forward tilt mechanism that may be enabled or disabled readily and easily, for example with the installation or removal of a lever. When the lever is removed, the forward tilt mechanism is disabled and the seat and backrest cannot tilt forward. When the lever is installed, a user may engage the forward tilt mechanism so that the seat and backrest tilt forward.

In a fourth aspect of the invention, the synchro-tilt chair control includes a dual-ratio action, meaning that the angle between the seat and back change at a first rate when the chair is reclined and at a second different rate when the chair is tilted forward. This feature solves the clam-shelling problem of the prior art. The geometry employed in the synchro-tilt control of the present invention is such that when the backrest and seat move from the neutral upright position into the forward tilt position, the rates of angular disposition of the backrest to the seat do not continue at the 2:1 ratio of the prior art. Rather, the closing movement reverses as the chair moves past the upright position so that the angle between the backrest and the seat increases. Accordingly, the backrest opens up with respect to the seat, therefore avoiding pinching of the user.

These and other objects, advantages, and features of the invention will be more readily understood and appreciated by reference to the detailed description of the preferred embodiment and the drawings.

DETAILED DESCRIPTION OF THE DRAWINGS

Figure 13:
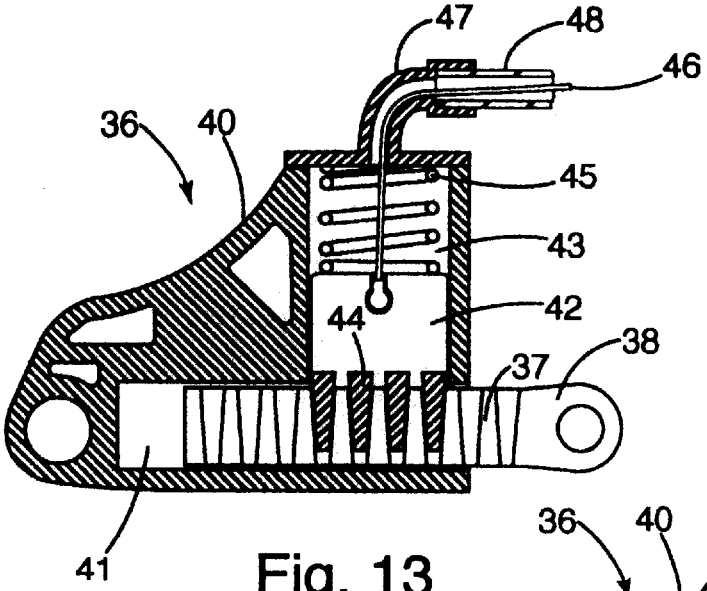
Figure 15:
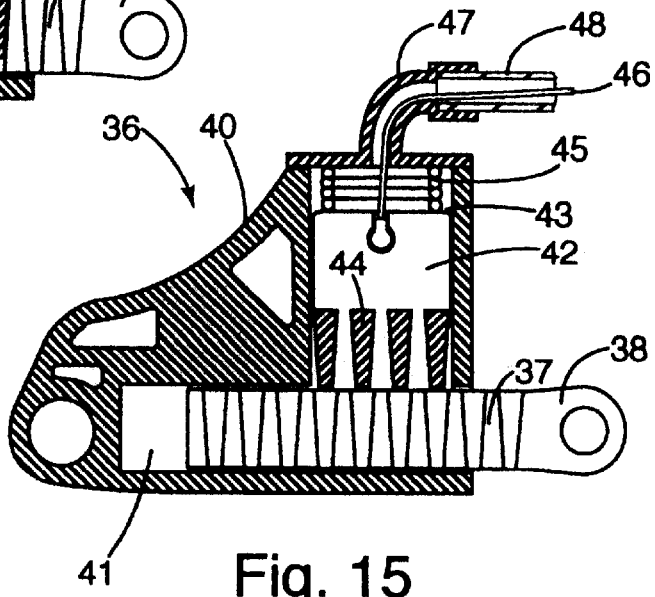
Figure 14:
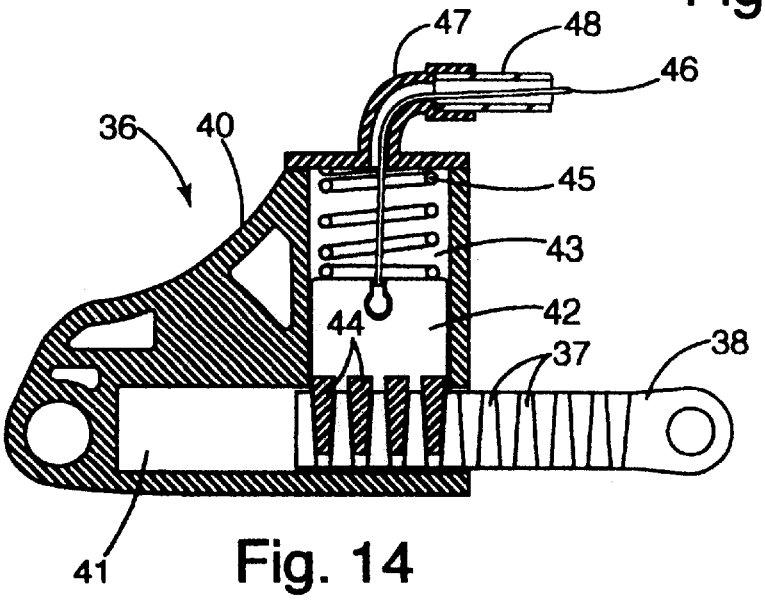
Figure 13A:
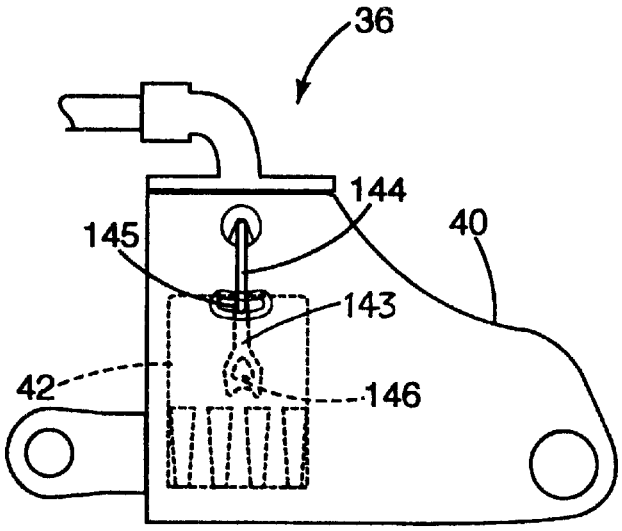
Figure 15A:
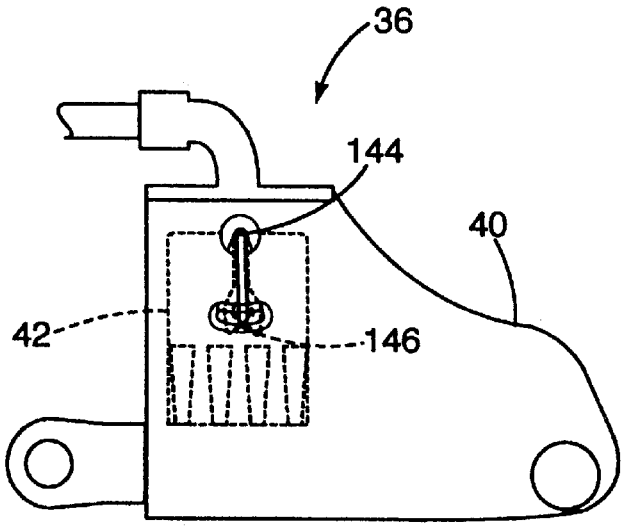
Figure 14A:
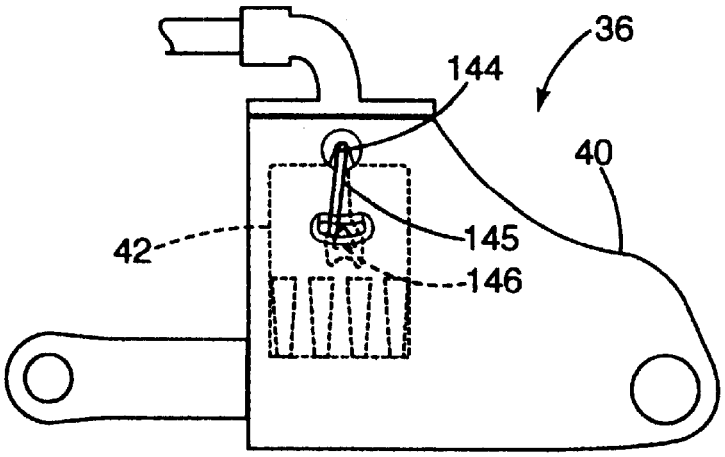
Figure 16:
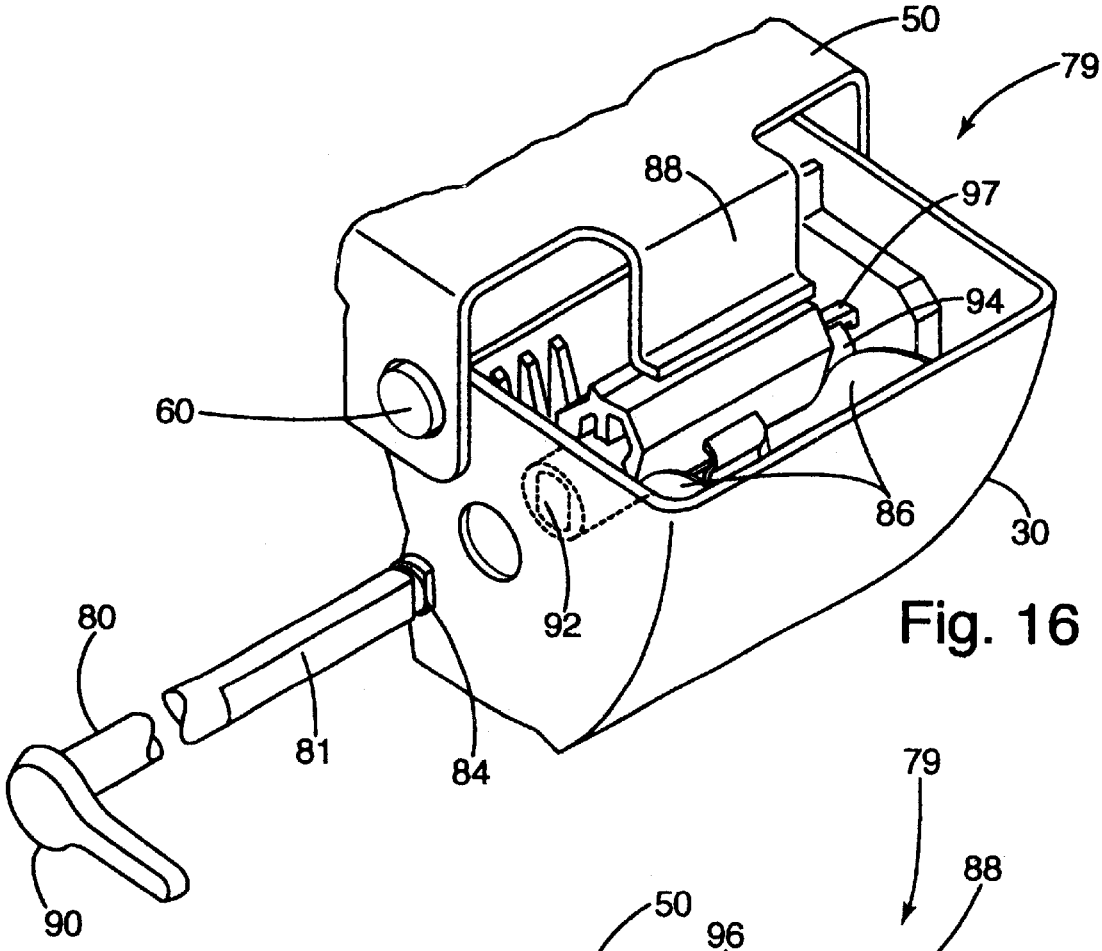
Figure 17:
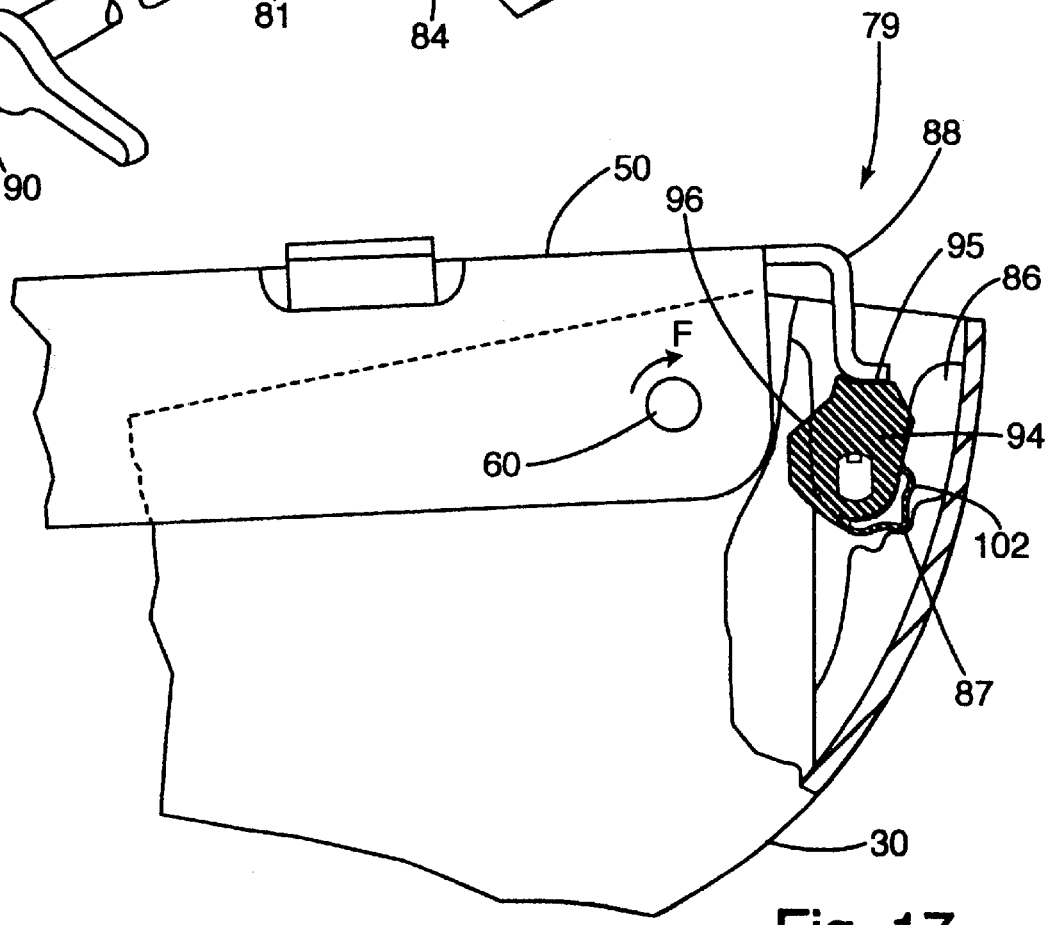
Figure 18:
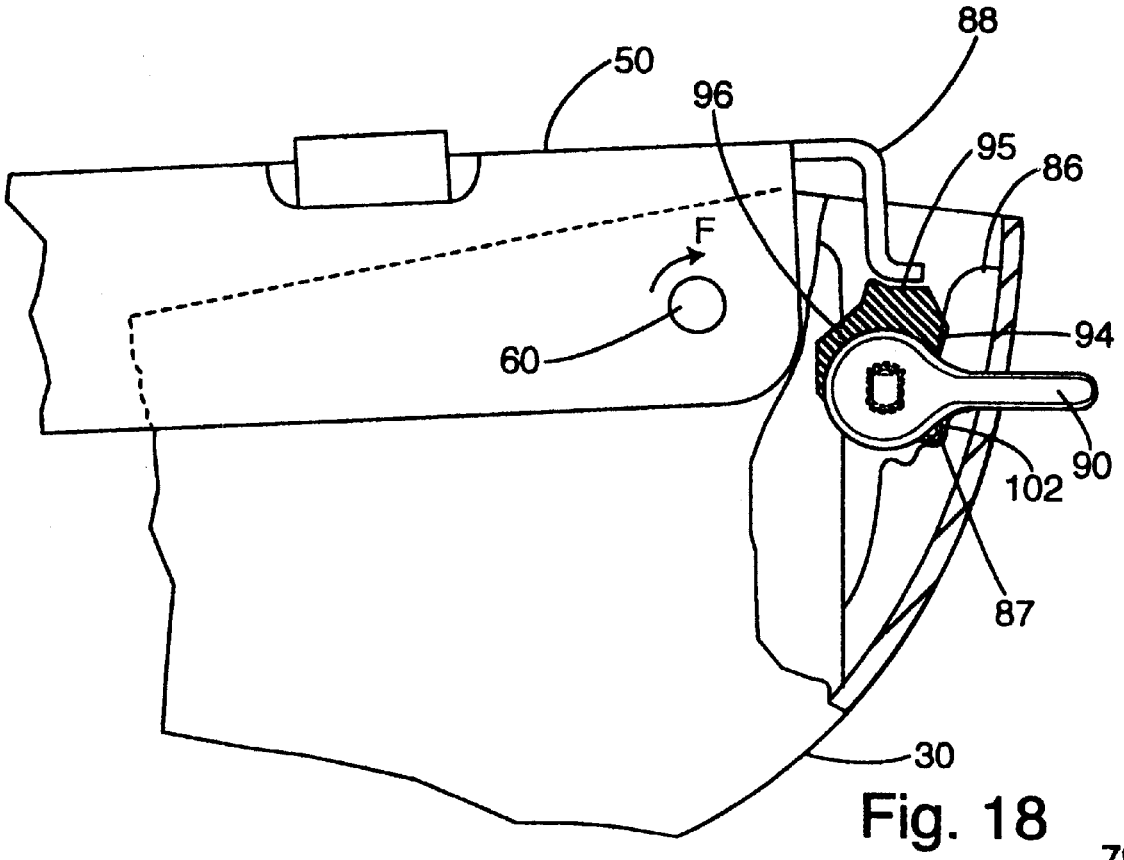
Figure 19:
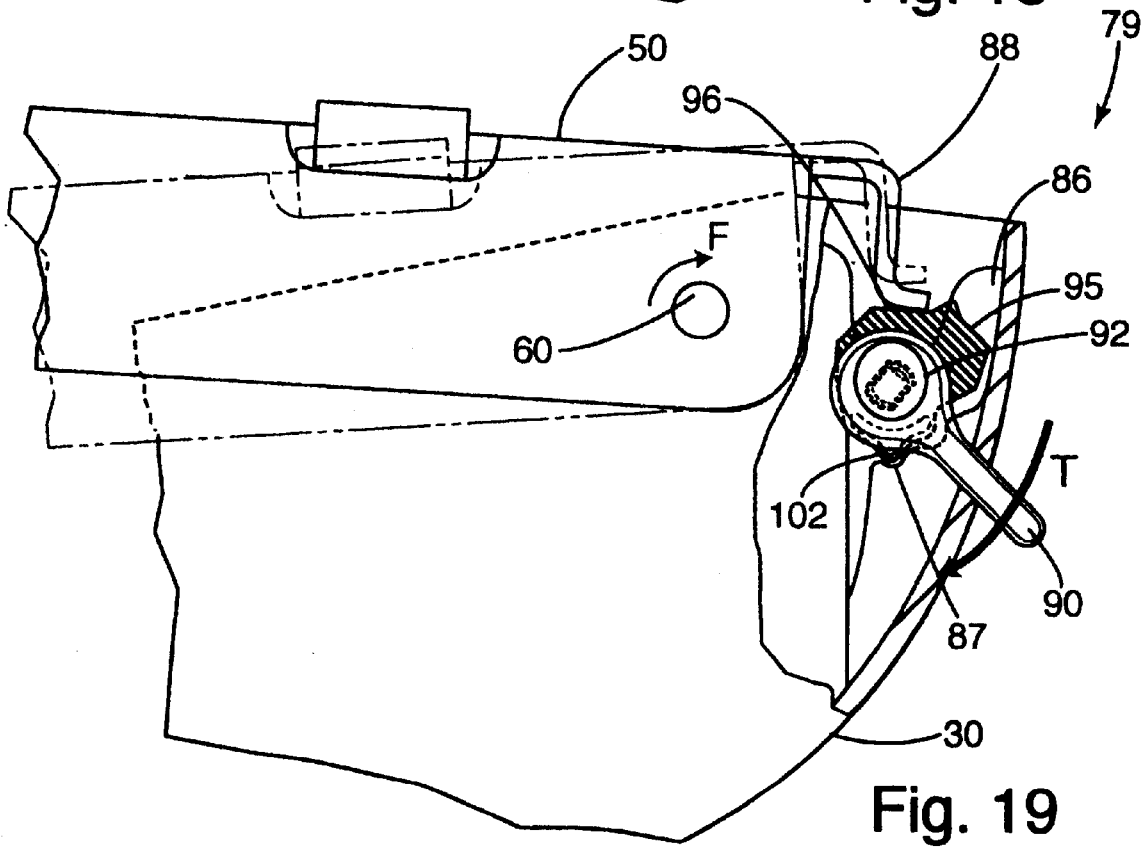
Figure 20:
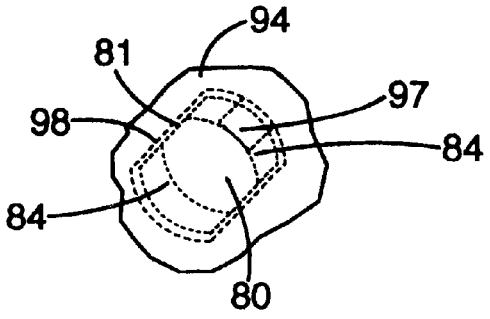
Figure 21:
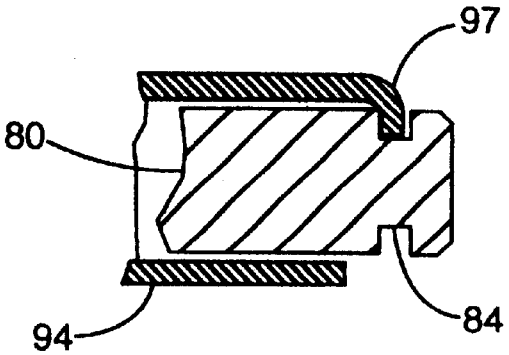
Figure 22:
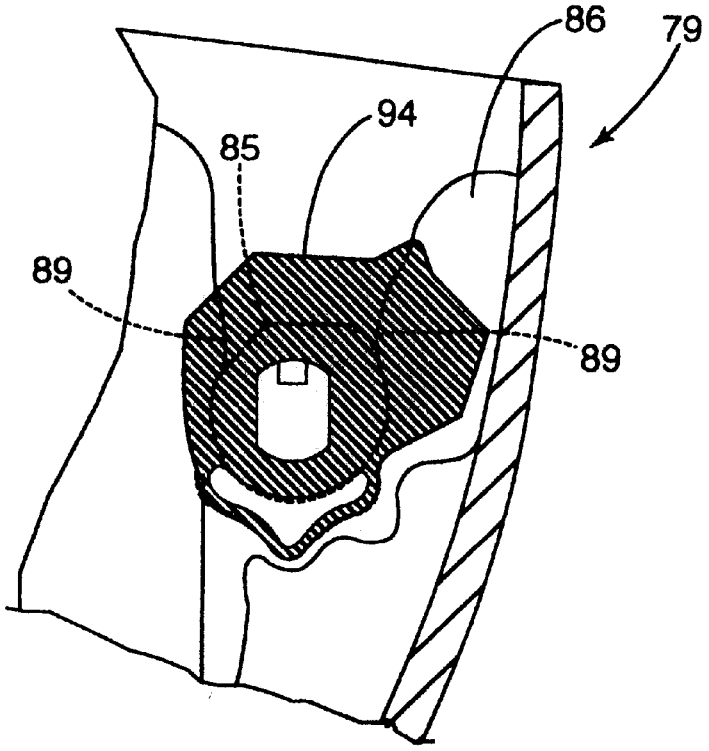
Figure 23:
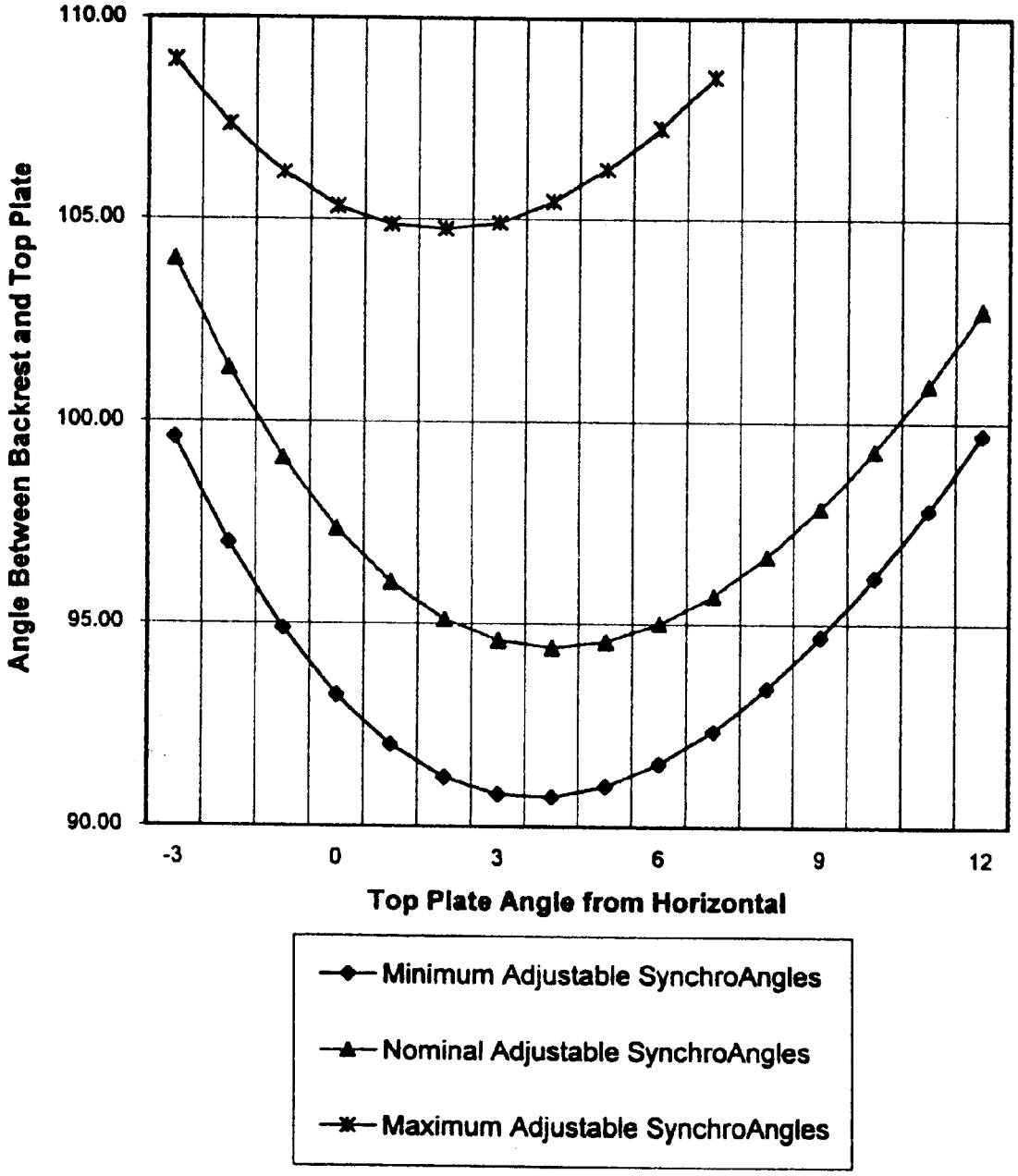
Figure 24:
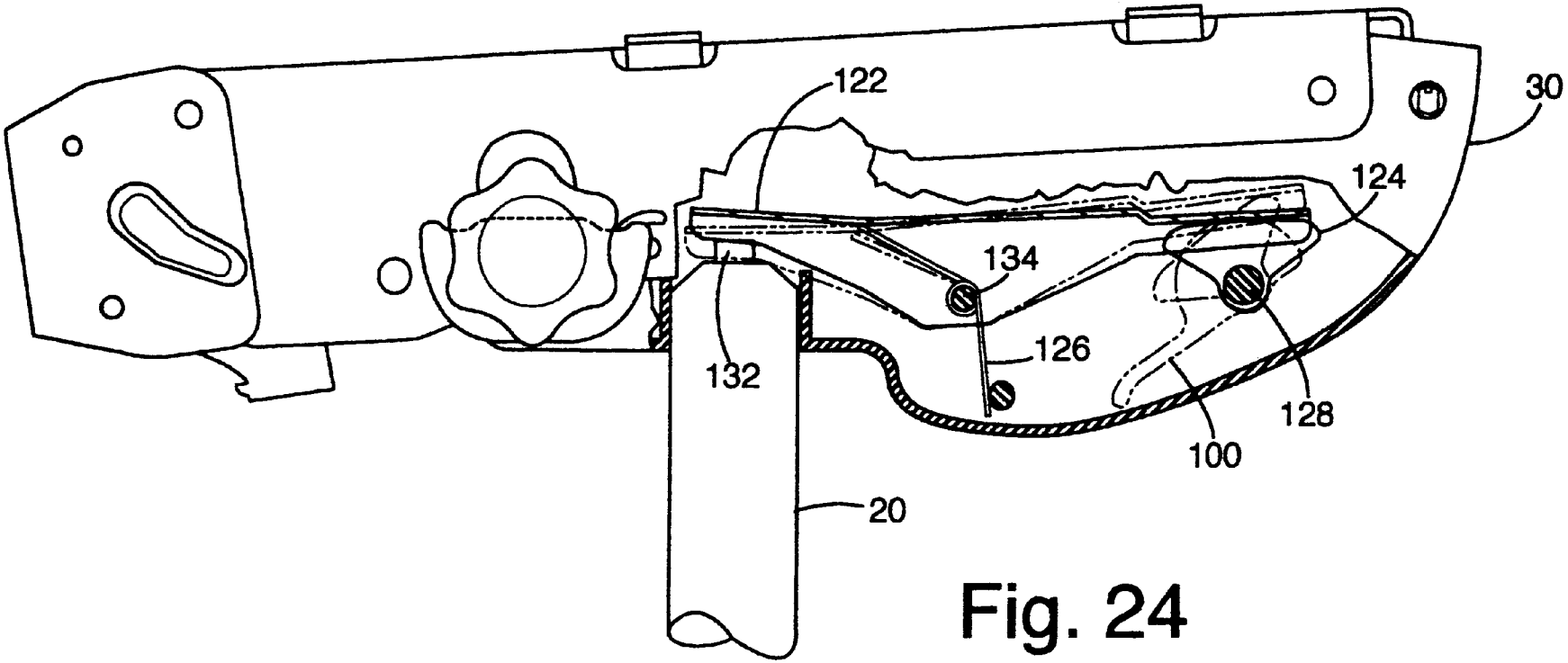
Figure 25:
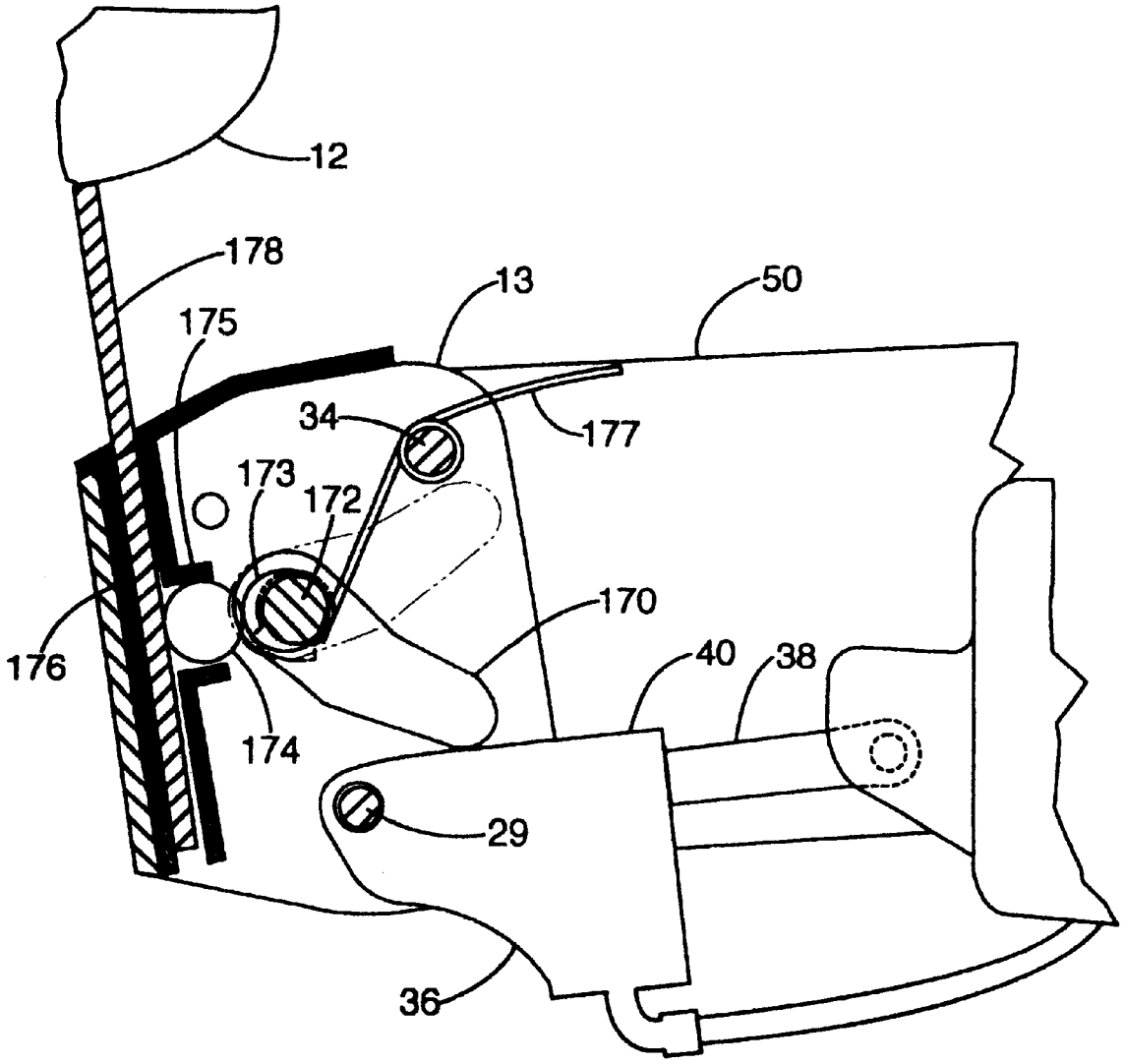
Figure 26:
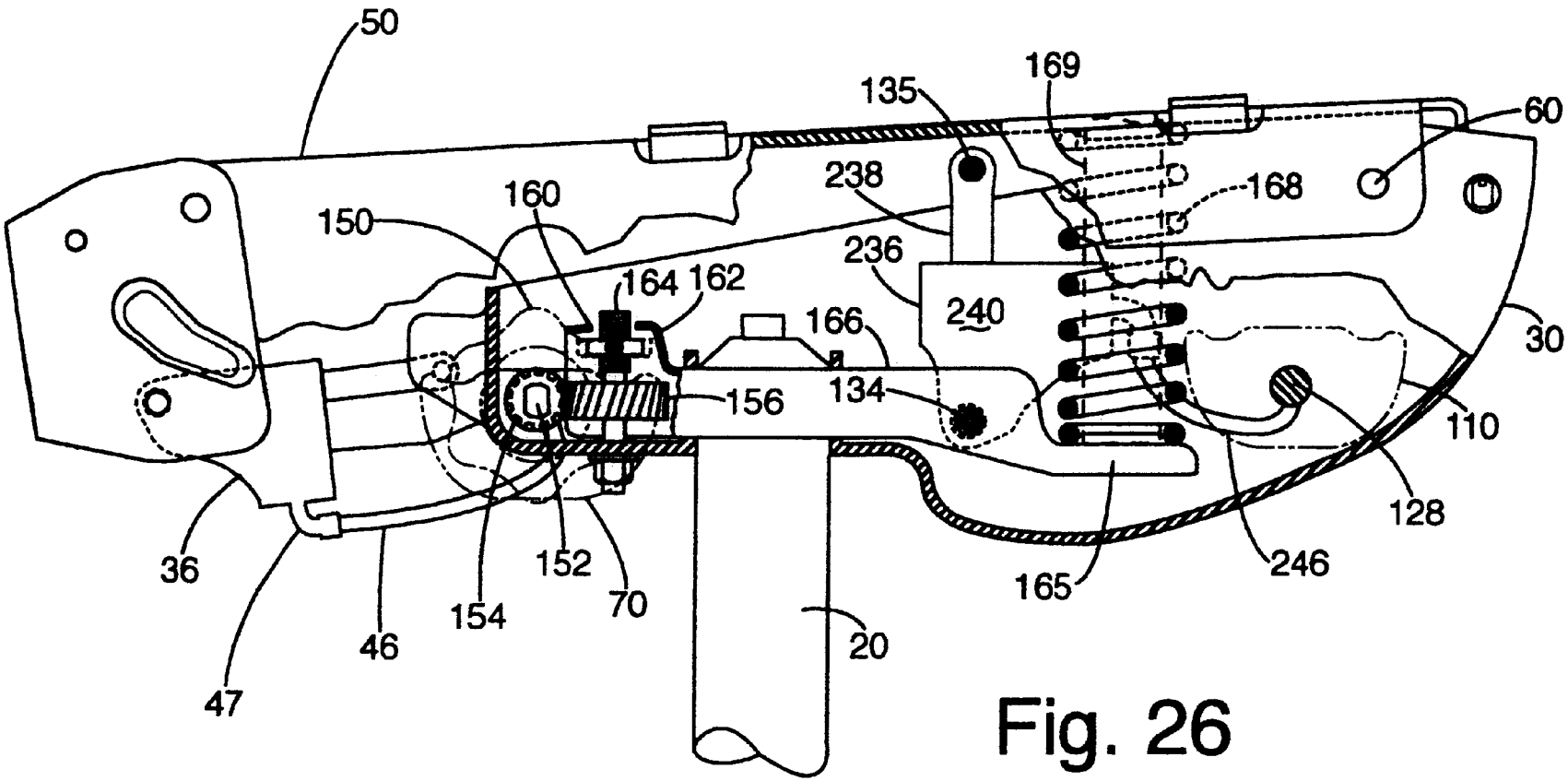

FIGS. 13 and 13*a* are sectional views of a rack assembly in a first engaged mode;

FIGS. 14 and 14*a* are sectional views of the rack assembly in a second engaged mode;

FIGS. 15 and 15*a* are sectional views of the rack assembly in a disengaged mode;

FIG. 16 is a perspective view of an articulating mechanism of the present invention;

FIG. 17 is a sectional view of a cam of the articulating mechanism;

FIG. 18 is a sectional view of the articulating mechanism with a lever installed;

FIG. 19 is a side elevational view of the articulating mechanism with the lever rotated to provide forward tilting ability;

FIG. 20 is a detail view of an articulating adjustment shaft installed in a bore of the articulating cam;

FIG. 21 is a sectional view of the articulating adjustment shaft installed in the bore of the articulating cam;

FIG. 22 is a detailed sectional view of the articulating cam and housing rib detents;

FIG. 23 is a graph illustrating adjustable synchro-angle data;

FIG. 24 is a cut-away detail of a chair height adjustment mechanism;

FIG. 25 is a side elevational view of a vertical backrest adjustment mechanism;

FIG. 26 is a sectional view of a tilt adjust mechanism; and

Figure 27:
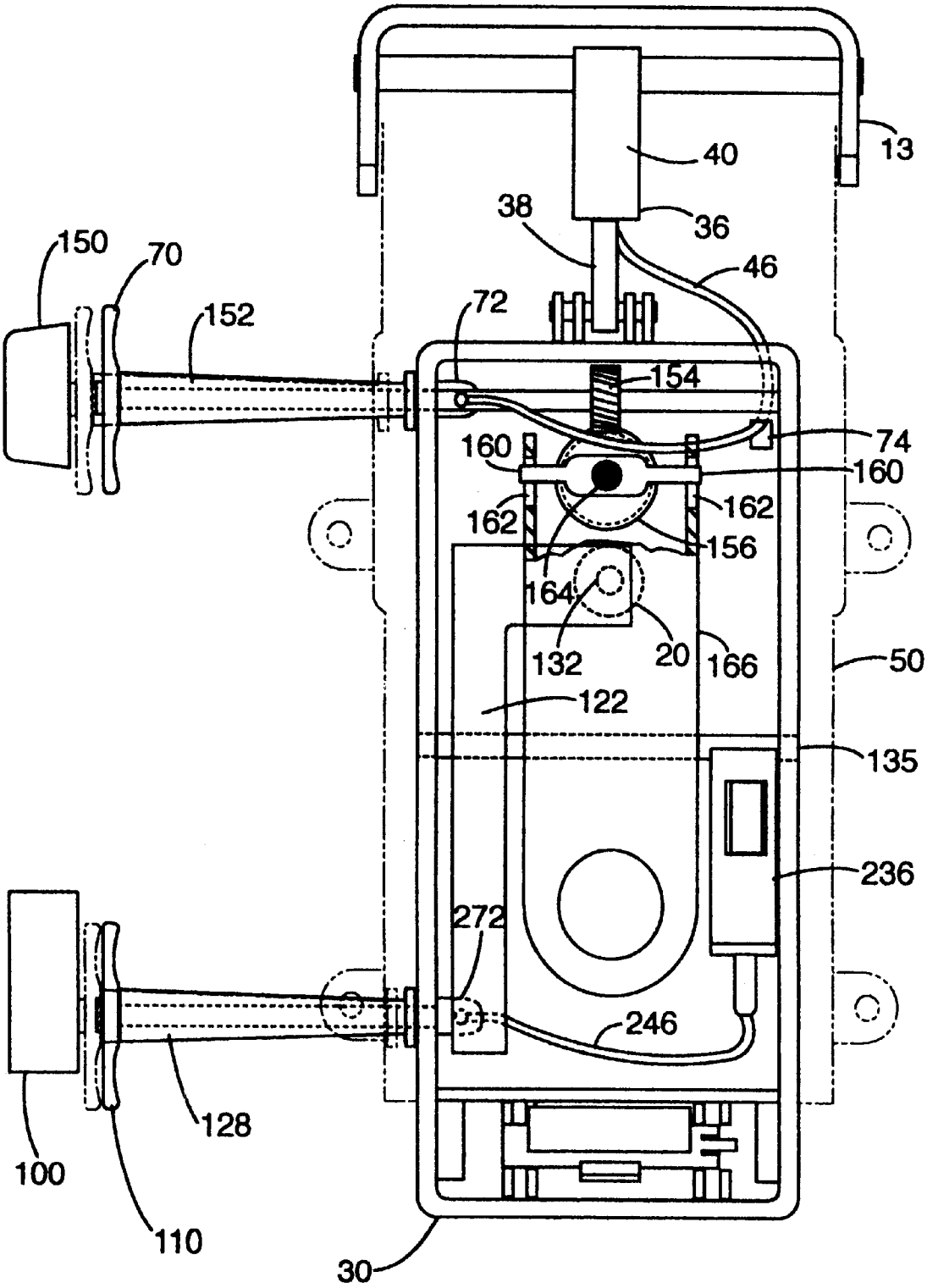

FIG. 27 is a top plan view of the tilt adjust mechanism.

DETAILED DESCRIPTION OF THE PREFERRED EMBODIMENT

Figure 1:
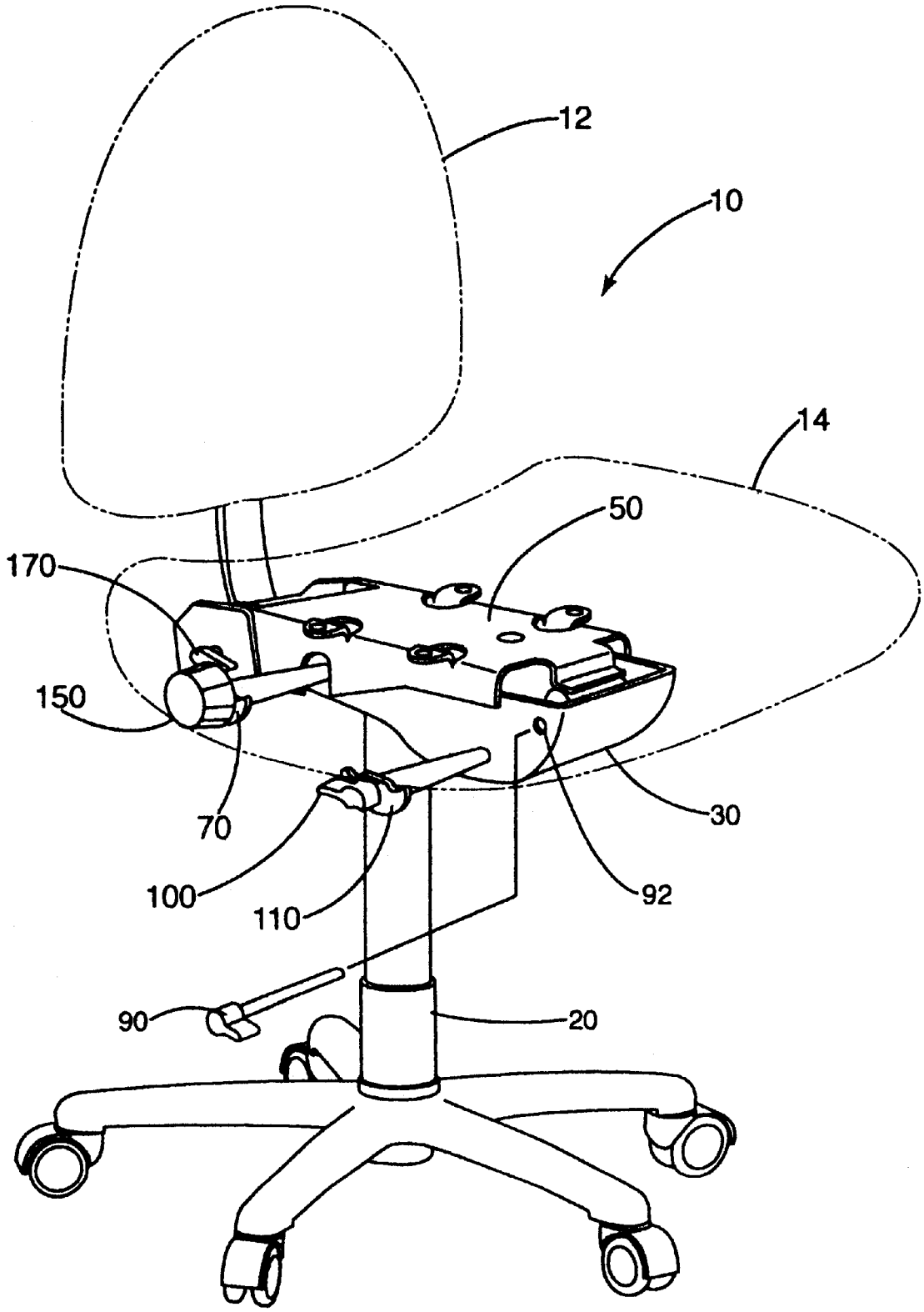
FIG. 1 is a perspective view of a chair of the present invention.
Figure 2:
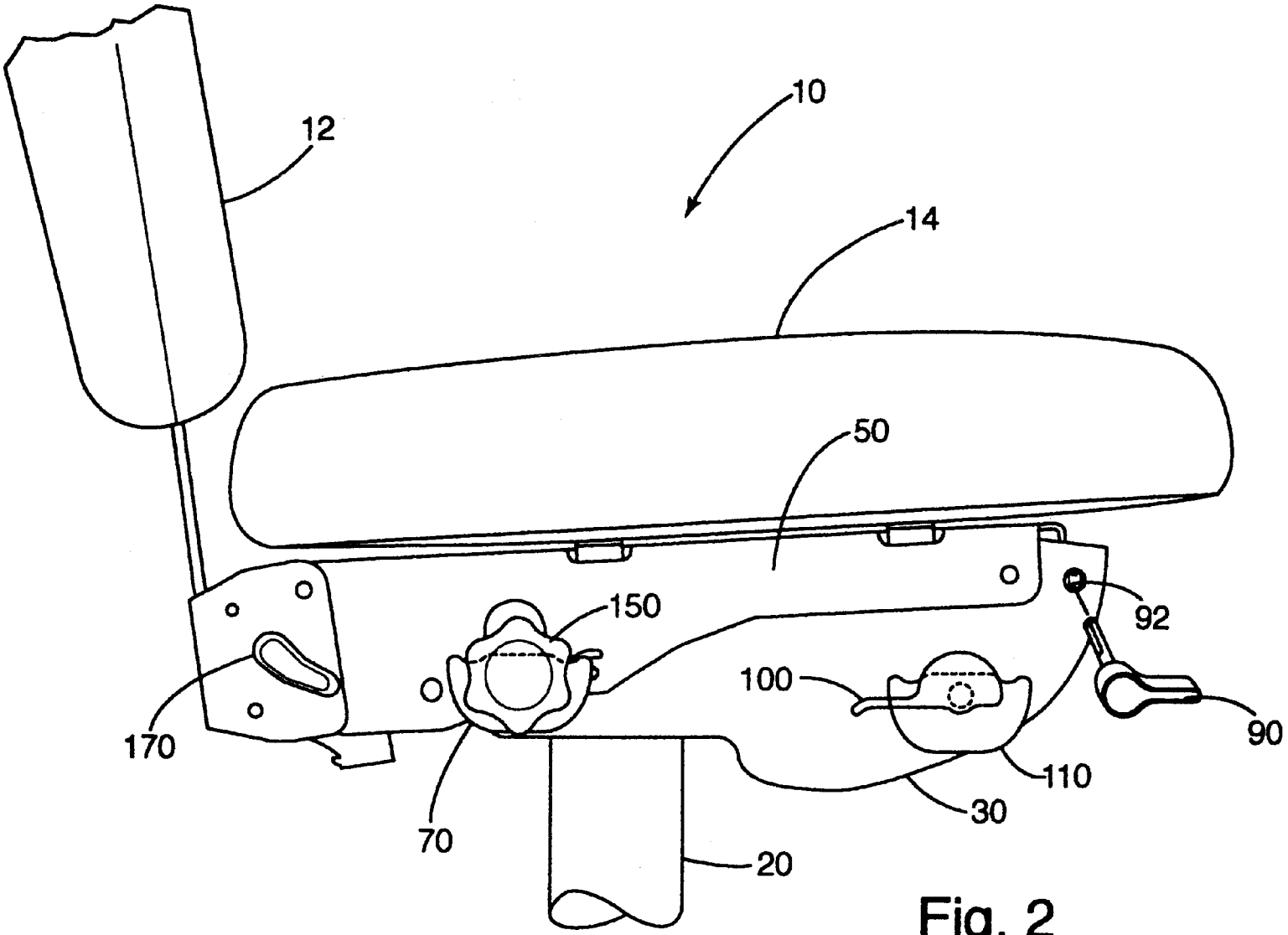
FIG. 2 is a side elevational view of chair controls.

A first embodiment of the chair of the present invention is depicted in FIGS. 1 and 2 and generally designated 10. The chair includes a housing 30 and a top plate 50 pivotally mounted to the housing. A conventional base 20 is coupled to the housing. The housing includes a variety of controls for reconfiguring the relationship between backrest 12 and seat 14. The synchro-angle pull sleeve 70 controls the angle between the backrest 12 and seat 14. As can be seen, seat 14 is mounted to top plate 50 in a conventional manner. Forward tilt lever 90 may be installed into forward tilt portal 92 to allow the user to forward tilt the seat 14 and backrest 12. The height adjust lever 100 is used to adjust the distance between the housing 30 and the floor. Seat angle adjust pull sleeve 110 allows the user to adjust the angle of the top plate 50 in relation to the housing 30. Tilt adjuster 150 permits the user to adjust the force required to recline in the chair. Backrest height adjust 170 controls the vertical displacement of the backrest 12 in relation to the seat 14. All of these components of the chair controls as described herein may be constructed of any suitable material including but not limited to metal, alloys, composites, or any combination thereof. The seat and backrest may be constructed of any plastic, foam, woven, natural or synthetic materials, or any combination thereof.

Articulating/Synchro Tilt

Figure 3:
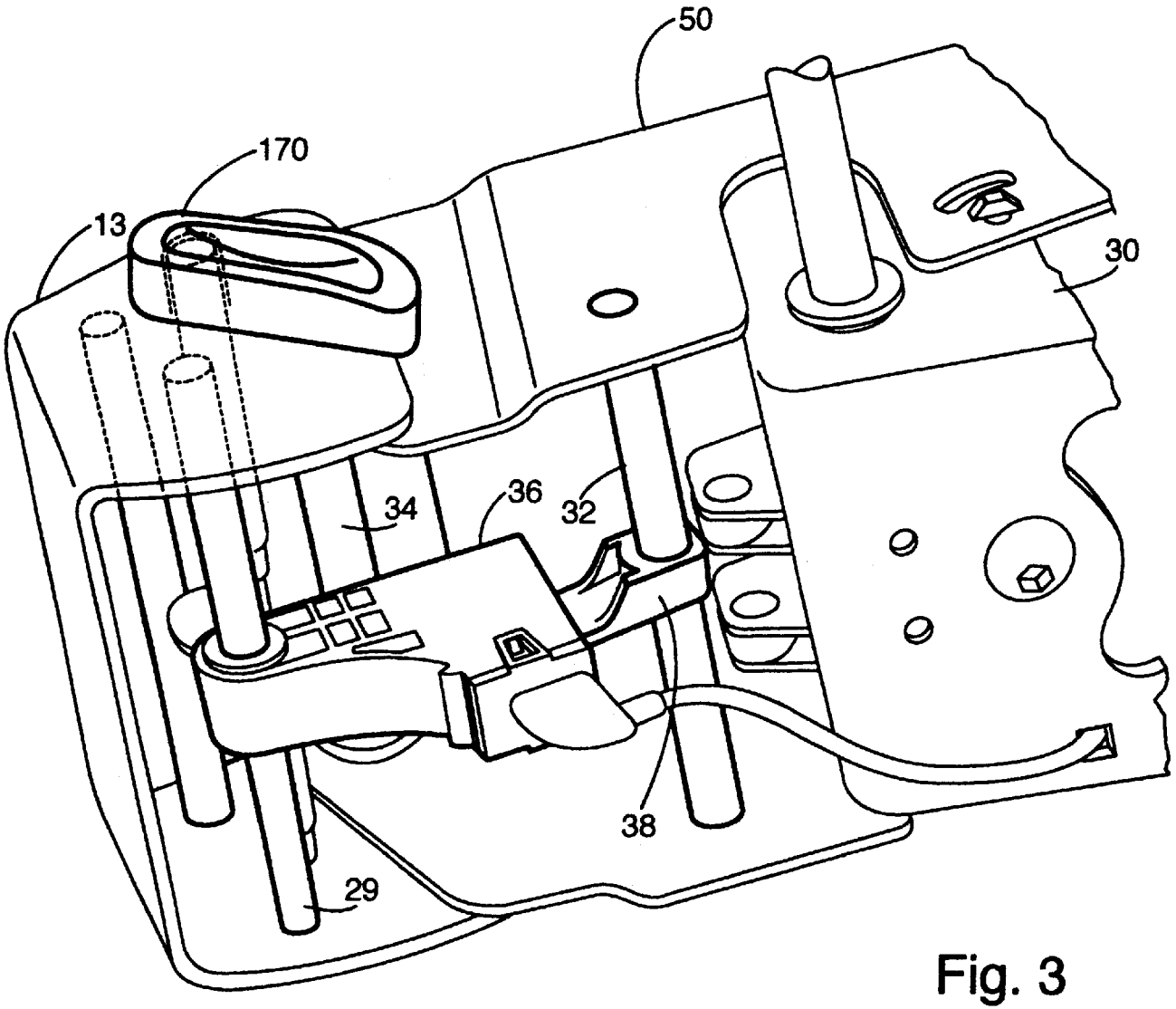
FIG. 3 is a perspective view of the chair in an articulating mode.

The chair of the present invention may readily be converted from an articulating chair to a synchro-tilt chair. FIGS. 3, 5 and 4, 8 illustrate the chair in an articulating and a synchro-tilt mode respectively. In the articulating mode of FIGS. 3 and 5, the backrest bracket 13 is held in fixed relation with respect to the top plate 50, that is, the bracket cannot pivot about backrest bracket pin 34. The top plate 50 is pivotally connected to the housing pivot pin 60 (FIG. 5). Seatback rivet 29 is connected to tilt pivot pin 32 by rack assembly 36 coupled to rack 38. It will be appreciated that the rack assembly may be substituted by any mechanism adjustable in length to provide different distances between seatback rivet 29 and tilt pivot pin 32 such as driven worm gears, screw jacks, ratcheting mechanisms and the like. Alternatively, the rack assembly 36 may be replaced with a connector that is nonadjustable in length so that seatback rivet 29 and tilt pivot pin 32 are always at the same distance from one another. The preferred rack assembly illustrated in FIG. 3 is adjustable in length and will be discussed in further detail below. With the seatback rivet 29 in fixed relation to tilt pivot pin 32, the backrest bracket 13 is non-pivotal about main backrest bracket pin 34 (FIG. 5) and maintains a consistent angular relation with respect to top plate 50. Accordingly, the chair is in an articulating mode.

Figure 4:
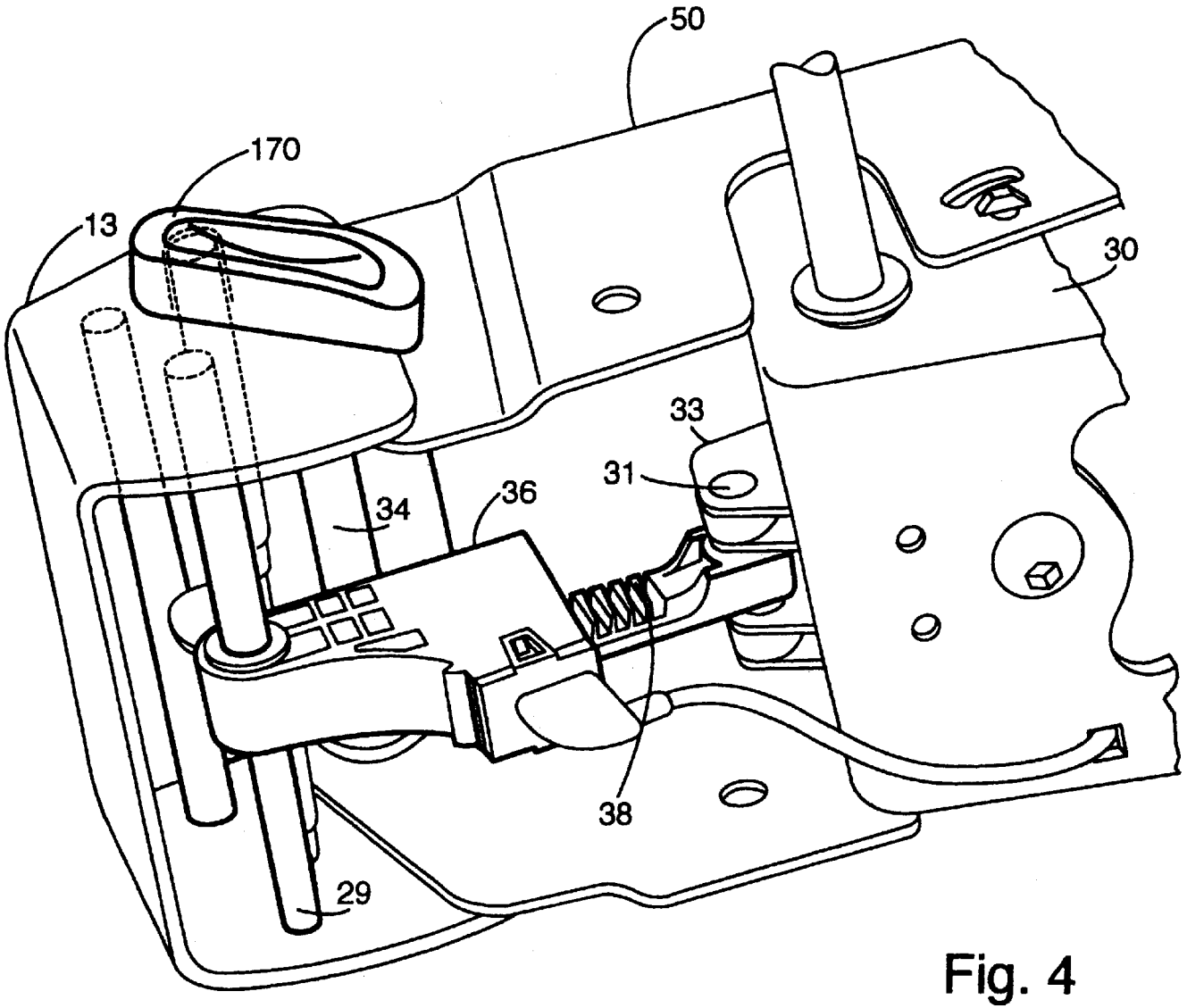
FIG. 4 is a perspective view of the chair in a synchro-tilt mode.
Figure 5:
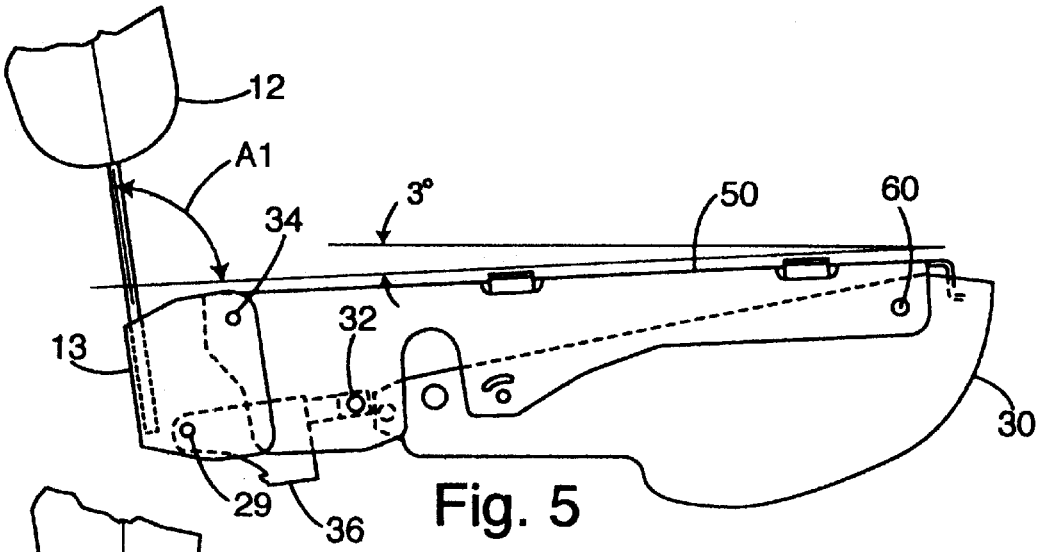
FIGS. 5–7 are side elevational views of the chair translating through angles in the articulating mode.
Figure 8:
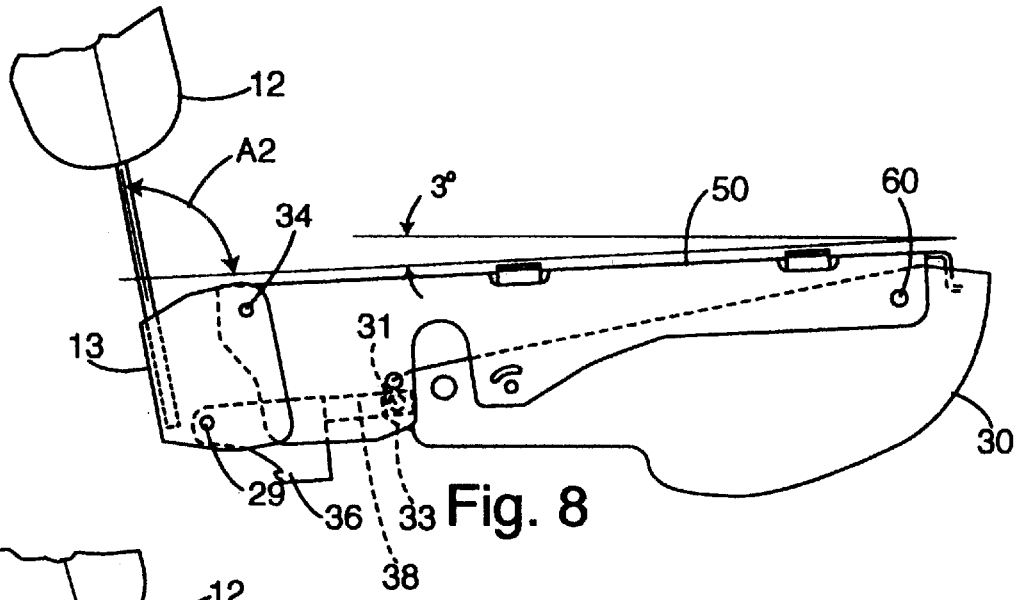
FIGS. 8–10 are side elevational views of the chair translating through angles in the synchro-tilt mode.

FIGS. 4 and 8 illustrate the chair in a synchro-tilt mode where the backrest bracket 13 may pivot in relation to top plate 50 about main backrest bracket pin 34. Rack assembly 36 couples the housing 30 to the seatback rivet 29. The synchro-tilt pivot pin 31 is disposed through the housing synchro-tilt bracket 33 to provide a pivot point to which rack 38 is coupled. As shown, rack 38 is slightly extended from the rack assembly 36. It will be appreciated and further discussed below that the rack assembly 36 is variable in length so that the distance between seatback rivet 29 and synchro-tilt pivot pin 31 may be altered. Alternatively, the rack assembly 36 may be replaced with a connector that is nonadjustable in length so that seatback rivet 29 and tilt pivot pin 32, and consequently, the synchro-tilt bracket 33, are always at the same distance from one another.

Fixed/Synchro-Tilt Operation

The chair of the present invention may be converted from an articulating to a synchro-tilt chair. With reference to FIGS. 3, 5 and 4, 8, a user may select between a fixed tilt or synchro-tilt chair by the connection of the rack assembly 36 and rack 38 to either the top plate 50 or the housing 30. As illustrated in FIGS. 3 and 5, the chair is in an articulating configuration with the rack assembly 36 and rack 38 coupled to tilt pivot pin 32. The tilt pivot pin 32 is removable, and the rack 38 may accordingly be connected to the housing synchro-tilt bracket 33 as illustrated in FIGS. 4 and 8. The user may insert synchro-tilt pivot pin 31 through housing synchro-tilt bracket 33 and rack 38 to convert the chair to a synchro-tilt chair.

Figure 6:
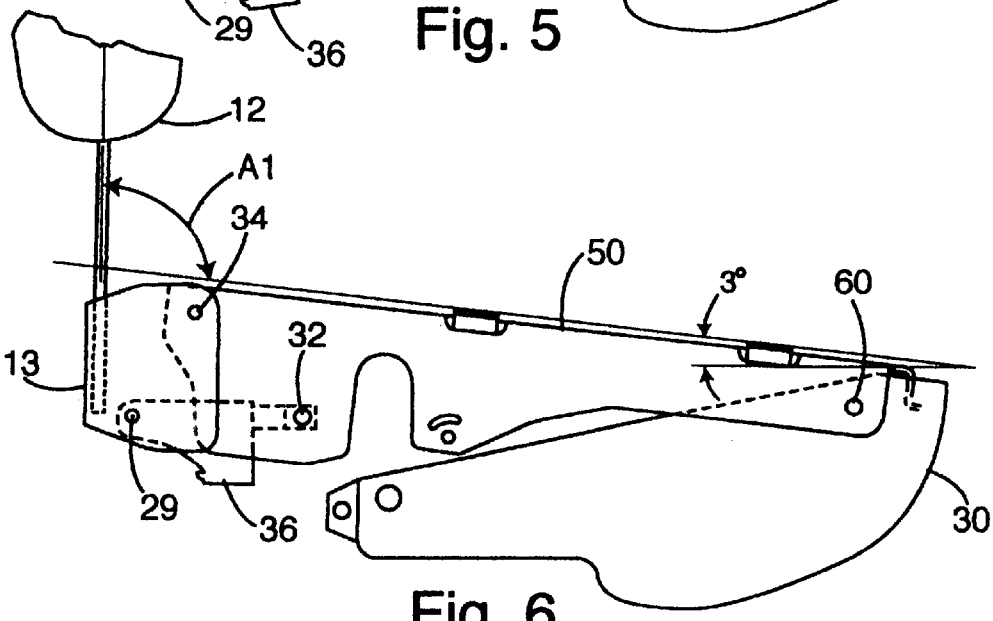
Figure 7:
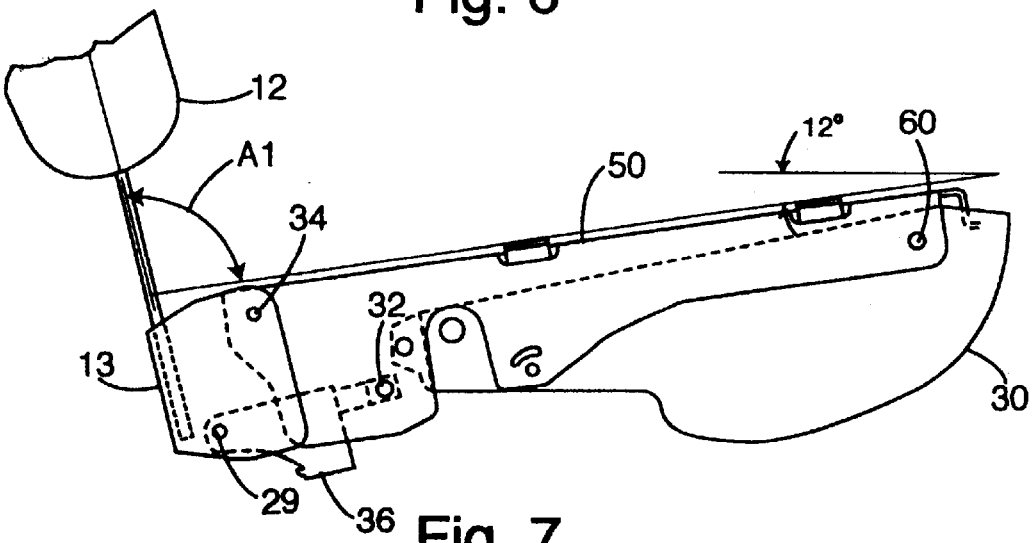

Reference is made to FIGS. 5–7 to illustrate the relationship between the backrest 12 and the housing 30 in the articulating configuration. As can be seen in these figures, the backrest bracket 13 does not tilt in relation to the top plate throughout a range of tilting of the top plate 50 in relation to housing 30. Backrest bracket 13 is held in fixed relation to the top plate 50 at pins 34, 29, and 32, and the backrest bracket 13. Consequently, the backrest 12 remains at fixed angle Al from top plate 50.

Figure 12:
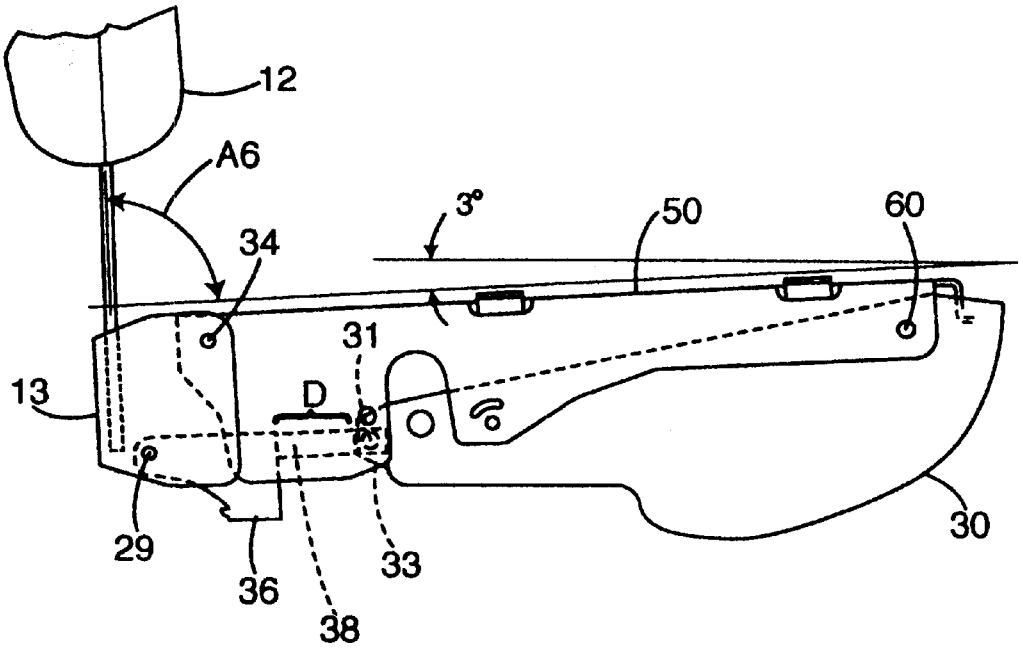
FIG. 12 is a side elevational view of the chair at a minimum adjustable synchro-angle.

In the preferred embodiment, the top plate 50 and backrest 12 may translate through multiple angles, from 3 degrees forward tilted from horizontal, illustrated in FIG. 6, to 12 degrees reclined from horizontal, illustrated in FIG. 7. The "neutral position" of the top plate is an angle 3 degrees reclined from horizontal as illustrated in FIG. 5. It will be appreciated that the "neutral position" may be configured at any pre-selected angle. It will also be appreciated that the configuration of the chair may be altered so that the maximum angle of reclination of the top plate from horizontal is up to 35 degrees and the maximum angle of forward tilt from horizontal of the top plate is up to 20 degrees.

Figure 9:
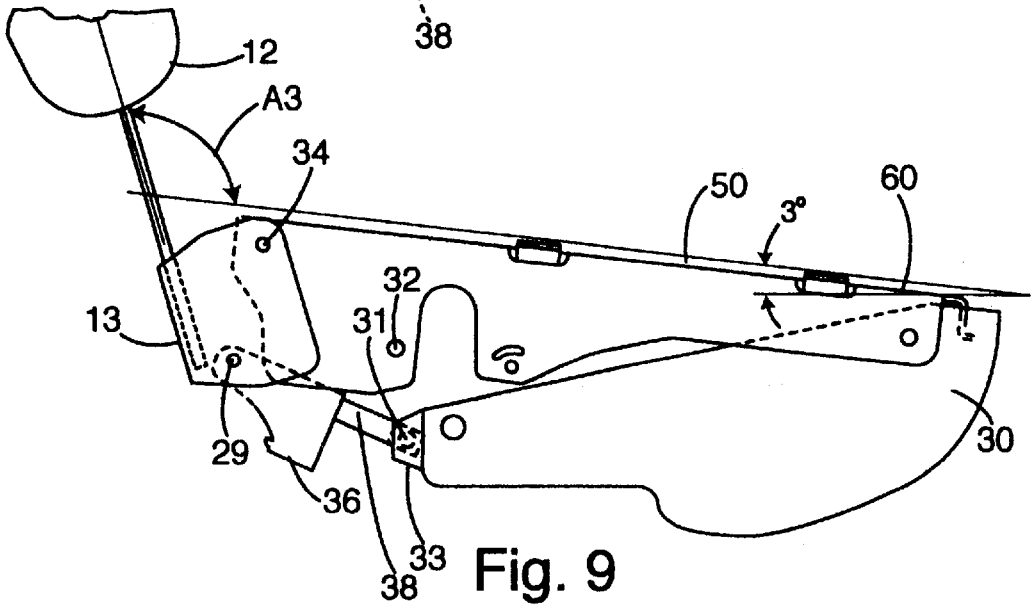
Figure 10:
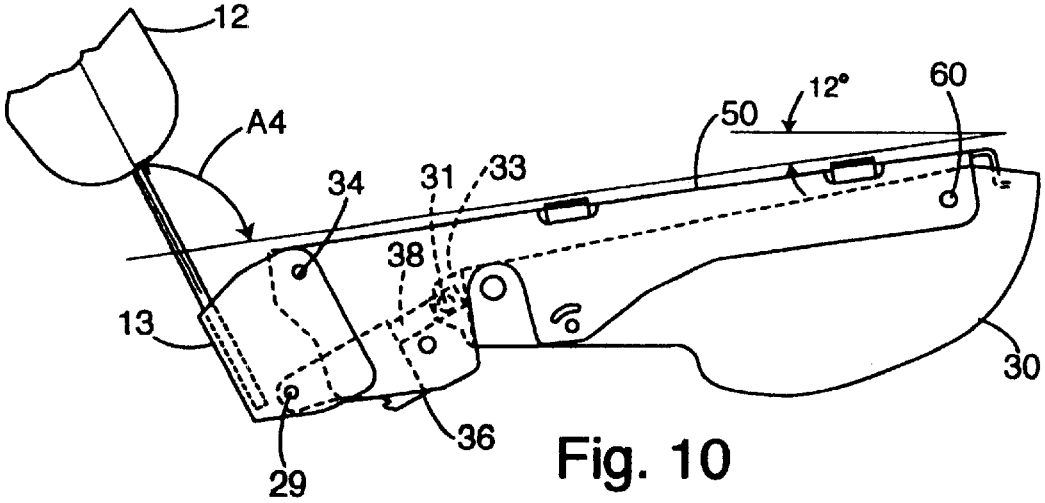

FIGS. 8–10 illustrate the chair of the present invention in a synchro-tilt mode. The difference between the articulating configuration of FIGS. 5–7 and the synchro-tilt configuration of FIGS. 8–10 is that the rack assembly 36 couples the backrest bracket 13 to (a) the top plate 50 at the tilt pivot pin 32 in the articulating mode and (b) the housing 30 at the synchro-tilt bracket 33 in the synchro-tilt mode. In the synchro-tilt configuration illustrated in FIGS. 8–10, the backrest bracket 13 pivots about main backrest bracket pin 34 as the chair reclines or tilts forward. For example, FIG. 8 illustrates the neutral position of the chair wherein the top plate 50 is at about an angle 3 degrees reclined from the horizontal. In this neutral position, the backrest bracket 13 and consequently the backrest 12 forms an angle A2 of about 103 degrees with top plate 50. It will be appreciated that depending on the geometry of the chair, angle A2 of this neutral position may be from about 130 degrees to about 70 degrees in a first embodiment, from about 110 degrees to about 90 degrees in a second embodiment, and from about 105 degrees to about 92 degrees in a third embodiment. A detailed description of how angle A2 may be adjusted is described below.

With reference to FIGS. 9 and 10, the top plate may be forward tilted as depicted in FIG. 9 or reclined as depicted in FIG. 10. In going from the configuration of FIG. 9 to the configuration of FIG. 10, the backrest bracket 13 pivots counterclockwise about main backrest bracket pin 34 so that the angle between the backrest 12 and the top plate 50 opens up. This is due to the rack assembly 36 connecting the lower-most portion of the backrest bracket at seatback rivet 29 to the housing synchro-tilt bracket 33. As can be seen, the angle between the backrest 12 and the top plate 50 increases the farther the top plate is reclined or forward tilted from horizontal.

In translating from a neutral position as illustrated in FIG. 8 to a forward tilt position as illustrated in FIG. 9, the angle between the backrest 12 and the top plate 50 opens up. As the top plate inclines in relation to the horizontal when pivoting about main pivot pin 60, the backrest bracket 13 rotates counterclockwise about main backrest bracket pin 34 because the backrest bracket 13 is coupled to the housing synchro-tilt bracket 33 by rack assembly 36. Accordingly, a user seated in the chair is afforded an opened seating position and is not pinched between the backrest 12 and the seat (not shown) attached to the top plate 50. It will be appreciated that depending on the configuration of the backrest bracket and the top plate, the rotational direction of the backrest bracket may be clockwise as well.

Adjustable Synchro-Tilt

The chair of the present invention also includes an adjustable synchro-tilt mechanism whereby the angle formed between the backrest 12 and the seat 14 may be altered throughout the entire range of forward tilting and reclination when the chair is in synchro-tilt mode. It will be appreciated that the synchro-tilt mechanism may also be used to adjust the angle between the seat and the backrest in articulating mode as desired.

Figure 11:
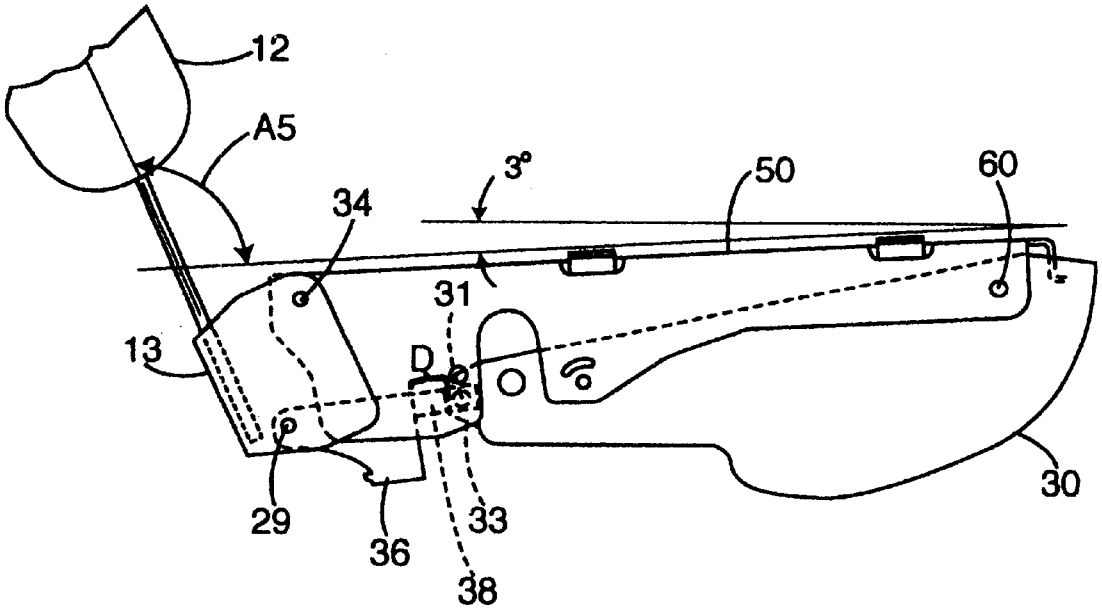
FIG. 11 is a side elevational view of the chair at a maximum adjustable synchro-angle.

FIGS. 11 and 12 best illustrate the adjustable synchro-tilt mechanism. The rack assembly 36 of the synchro-tilt mechanism couples the backrest bracket 13 to the housing 30. The rack assembly 36 is pinned to the backrest bracket 13 at seatback rivet 29. The rack 38 of the rack assembly 36 is pivotally pinned to the housing synchro-tilt bracket 33 with pin 31.

It will be appreciated that the rack assembly 36 may be substituted with any sort of connector that is adjustable in length so that the angle formed between the backrest 12 and the top plate 50 may be increased or decreased in the synchro-tilt or articulating mode. Alternatively, the rack assembly may be replaced with a connector of fixed length; however, the initial synchro-tilt angle in the neutral position would consequently be fixed. Additionally, the rack assembly 36 may be reversed so that the rack 38 attaches to the seatback rivet 29 and the rack assembly 36 is pinned to the synchro-tilt pivot pin.

In the preferred embodiment, the rack assembly is a conventional pawl rack assembly as illustrated in FIGS. 13–15. The rack assembly includes a body 40, a rack guide 41, a panel 42 and a pawl guide 43. Spring 45 biases the pawl 42 so that pawl teeth 44 may engage the rack teeth 37 of rack 38. Cable 46 is operably connected to the pawl 42 to move the pawl 42 within the pawl guide 43. Cable guide 47 connects to body 40 in a conventional manner to provide an outlet for the cable 46. Cable 46 may be encapsulated within a sleeve 48 to prevent unnecessary interference with the function of the cable 46. The pawl 42 of the present invention is preferably outfitted with a Y-ramp system to allow multi-positioning of the pawl within the pawl guide 43. As depicted in FIGS. 13*a*–15*a*, a conventional Y-ramp system 143 is included in a face of the pawl 42. The Y-ramp 143 interacts with pin 144 that is coupled to the exterior of the body 40.

Operation of Adjustable Synchro-Tilt

To adjust the angle of the backrest 12 in relation to the top plate 50, the rack 38 is extended and retracted from the rack assembly 36 to alter the distance D between the rack assembly 36 and the housing synchro-tilt bracket 33. This adjustment in the distance is illustrated in comparing FIGS. 11 and 12. From FIG. 11 to FIG. 12, the rack 38 has been extended from the rack assembly 36 so that the angle formed between backrest 12 and top plate 50 is decreased, that is, angle A5 closes to angle A6. Conversely, in going from FIG. 12 to FIG. 11, the rack 38 is retracted into the rack assembly 36 so that the angle formed between the backrest 12 and the top plate 50 increases, that is, angle A6 opens up to angle A5. It will be appreciated that this extension and retraction of a rack 38 from the rack assembly 36 also may be used to alter the angle between the backrest 12 and the top plate 50 when the chair is in the articulating mode, that is, when the rack 38 is attached to the top plate 50 at pin 32 as illustrated in FIGS. 4 and 5.

When the pawl 42 engages rack 38 as illustrated in FIGS. 13 and 13*a*, pin 144 is in an engaged position 145. As illustrated in FIGS. 15 and 15*a*, when the pawl teeth 44 are disengaged from the rack teeth 39, the pin 144 is in a disengaged position 146 as illustrated in FIG. 15*a*. Accordingly, the rack 38 may extend and retract freely from the body 40.

With reference to FIGS. 13–15 and 13*a*–15*a*, the operation of the rack assembly 36 used in the present invention will now be described. As shown in FIGS. 13 and 13*a*, the pawl 42 is in an engaged position so that the pawl teeth 44 engage rack teeth 37 whereby the rack 38 cannot retract or extend from rack slide 41. The spring pushes the pawl 42 into engagement with the rack 38. With further reference to FIG. 13*a*, the pin 144 is in the pawl engaged position 145 in the Y-ramp 143.

To disengage the pawl, the cable 46 is pulled outward through cable guide 47 whereby the spring 45 is compressed and pawl 42 slides within pawl guide 43. The cable 46 is actuated remotely by a pull sleeve disposed in the housing of the chair 30, as will be discussed below in further detail. It will be appreciated by those skilled that any mechanism capable of extending and retracting the cable 46 may be used. Pawl teeth 44 are disengaged from rack teeth 37 whereby the rack 38 is free to slide within rack guide 41. With reference to FIGS. 14 and 14*a*, the pin 144 slides in the Y-ramp 143 as indicated until the pawl teeth 44 are fully disengaged from the rack teeth 39. At this point, illustrated in FIG. 15*a*, the pin comes to rest in the pawl disengaged position 146 of the Y-ramp 143. With the pawl 42 locked in this position by the pin 144, the rack 38 is free to slide within the rack guide 41 to extended or retracted positions.

To re-engage the pawl teeth 44 with the rack teeth 37, the cable 46 must be momentarily pulled once again through the cable guide 47 to remove the pin 144 from the pawl disengaged position 146. After the pull of the pawl removes the pin 144 from the pawl disengaged position 146, the spring 45 pushes the pawl within the pawl guide 43 so that the pawl teeth 44 re-engage the rack teeth 37 as illustrated in FIGS. 13 and 13*a*. Accordingly, the pin 144 returns to the pawl engaged position 145. With this mechanism, the rack 38 may be selectively retracted and extended from the body 40 of the rack assembly 36. Further; the distance between the two pivot points to which the rack 38 and body 40 are attached may be selectively altered. Consequently, the angle between the top plate 50 and the backrest 12 may be selected by a user.

The rack assembly 36 may be remotely actuated by the synchro angle pull sleeve 70 as depicted in FIG. 27. To cause the rack 38 to extend or retract from the rack assembly 36, and consequently alter the angle between the backrest and the seat, the rack must be disengaged. To disengage the rack assembly 36 and tilt the backrest bracket 13 and consequently the backrest in relation to the top plate 50, a user pulls the synchro angle pull sleeve 70 in a direction outward from the housing 30 a predetermined distance, indicated in broken lines. This action pulls cable 46 to disengage the rack assembly 36. Once in this disengaged mode, the rack 38 is free to extend and retract from the rack body 40 as described in detail above. After the user selects a desired backrest angle, she again pulls outward on the pull sleeve 70 to re-engage the rack assembly 36. Accordingly, the rack 38 is locked in relation to the rack body 40. It will be appreciated that the pull sleeve 70 does not impede the rotation of the tilt adjustment shaft 152 about which it is circumferentially disposed. As further will be appreciated, any remote actuating mechanism may be substituted for the pull sleeve 70 to engage and disengage the rack assembly 36 to promote tilting of the backrest 12 with respect to the top plate 50.

Forward Tilt

With reference to FIG. 16, the selectable forward tilt mechanism 79 generally includes a forward tilt cam 94 rotatably retained in the housing 30 by housing ribs 86. The cam 94 is positioned to selectively engage top plate flange 88. Removable forward tilt shaft 80 is disposable in the forward tilt portal 92 to rotate forward tilt cam 94. As best depicted in FIGS. 17 and 18, cam 94 includes first cam surface 95 and second cam surface 96. First cam surface 95 is disposable in the path of travel of top plate flange 88 to restrict rotation of top plate 50 about fixed housing pivot pin 60 in direction F further than as depicted. With reference to FIG. 19 in contrast, second cam surface is disposable in the path of travel of top flange plate 88 to allow rotation of top plate 50 about housing pivot pin 60 in direction F a predetermined angle to allow the chair to forward tilt. It will be appreciated that the top plate flange 88 may be replaced with any sort of conventional protrusion from the top plate that would sufficiently engage the cam to provide forward tilt control.

With reference to FIG. 17, forward tilt cam 94 further includes cam positioning protrusions 102 which selectively engage rib detent 87. As shown in FIG. 17, the cam is prevented from rotating from the position shown due to engagement of the rib detent 87 with the cam positioning protrusion 102. Similarly in FIG. 19, the cam 94 is prevented from rotational translation from the position as shown due to engagement of the rib detent 87 with the cam positioning protrusion 102. Additional cam positioning protrusions and rib detents may be added to the cam and ribs as desired to provide a plurality of forward tilt positions.

With particular reference to FIG. 20, the cam 94 includes a partially squared bore 98 for receiving the squared portion 81 of forward tilt shaft 80 to prevent rotation of the shaft 80 in relation to the cam 94. As illustrated in FIGS. 16, 20 and 21, the cam also includes finger 97. When the forward tilt shaft 80 is inserted into the partially squared bore 98 of cam 94, finger 97 engages key groove 84 to hold forward tilt shaft 80 in locked relation with respect to the forward tilt cam 94. The squared portion of 81 of the forward tilt shaft 80 engages the partially squared internal bore 98 of the cam to further prevent rotational translation of the forward tilt shaft 80 with respect to the partially squared bore 98. Forward tilt lever 90 is attached to the forward tilt shaft 80 to provide the user with a grasping surface to rotate forward tilt shaft 80 and consequently the cam 94. It will be appreciated that any configuration of the internal bore of the camshaft and the forward tilt shaft may be used to prevent rotational translation of the shaft with relation to the cam so that the cam may be rotated.

With reference to FIG. 22, the cam 94 is retained in the housing by cam main tube 85 being held in place by housing ribs 86. The housing ribs include slight protrusions 89 that hold the cam main tube 85 in fixed relation to the housing rib 86, while still allowing the cam main tube 85 and forward tilt cam 94 to rotate. As will be appreciated by those skilled in the art, the cam main tube and consequently the cam 94 may be retained in fixed relation within the housing 30 by other conventional means.

Forward Tilt Operation

A chair including the forward tilt mechanism of the present invention is delivered to a distributor of such chairs with the forward tilt shaft 80 removed from the cam 94. Accordingly, the distributor may then distribute the chair to consumers with the forward tilt capability of the chair disengaged, that is, without the forward tilt shaft 80. Alternatively, the distributor may distribute the chair to consumers with the forward tilt shaft 80 installed. Accordingly, the end user of the chair may select between a forward tilt or non-forward tilting configuration.

It will be appreciated that the selectively installable actuator or adjuster used with the forward tilt control of the preferred embodiment may be used with any chair control feature. For example, the actuator may be implemented or used in conjunction with height controls for seats, backrests, armrest, or any component of a chair, tilt adjusters, seat and backrest angle controls, seat and backrest sliding controls, or any other chair control as the application requires.

FIG. 18 illustrates the chair with the forward tilt mechanism configured to restrict forward tilt. The top plate flange 88 engages first cam surface 95 so that the top plate 50 cannot forward tilt in direction F about housing pivot pin 60. The cam is further restricted from rotation due to engagement of cam positioning protrusions 102 engaging rib detent 87.

With reference to FIG. 19, to reconfigure the cam so that the chair may attain a forward tilt position, a user must grasp an installed forward tilt lever 90 and rotate it in direction T as indicated in FIG. 19. Due to the coupling of lever 90 to the forward tilt shaft 80 and consequently the cam 94, the cam also rotates in direction T. Once the cam has rotated sufficiently forward, the top plate 50 may rotate in direction F about main pivot pin 60. The top plate flange 88 engages second cam surface 96 once the top plate 50 attains a forward tilt position. Cam positioning protrusions 102 also engage rib detent 87 to prevent rotational translation of cam 94 in this forward tilt mode. To reconfigure the chair to the restricted forward tilt configuration, the above steps are reversed, as will be appreciated by those skilled in the art.

Dual-Ratio Synchro-Tilt

With reference to FIGS. 8–12, there will now be described the dual-ratio synchro-tilt feature of the present invention. Generally, the dual-ratio synchro-tilt feature of the present invention is the product of the geometric configuration of the chair's components. In effect, the chair reclines and forward tilts in a four-bar relationship. "Four-bar" relationship means that each of four pivot points is connected to two other of the four pivot points by a member. In the preferred embodiment, generally depicted in FIG. 8, the main pivot point 60 is connected to (a) the main bracket pin 34 by top plate 50 and (b) the synchro-tilt pivot pin 31 by housing 30; and the seat back rivet 29 is connected to (c) the main bracket pin 34 by backrest bracket 13 and (d) synchro-tilt pivot pin 31 by rack assembly 36.

Due to the four-bar relationship of the preferred embodiment, the angle between the backrest 12 and the top plate 50: (1) increases when the top plate is reclined from a neutral or horizontal position; and (2) increases when the top plate is forward tilted from a neutral or horizontal position. Because this angle increases during forward tilt from neutral or horizontal, a user seated in the chair is not pinched between the backrest 12 and top plate 50.

Dual-Ratio Synchro-Tilt Operation

The operation of the dual-ratio synchro-tilt feature will now be described. The dual-ratio synchro-tilt feature controls the configuration of the chair as it is reclined or forward tilted from a neutral position. FIG. 8 depicts the chair in its neutral position. In the preferred embodiment, the neutral position refers to that position where the top plate 50 is reclined from horizontal up to 20 degrees, preferably about 3 degrees. The backrest may be at any angle from the top plate in this neutral position as desired.

When the chair is reclined from the neutral position, the top plate 50 tilts about housing pivot pin 60. The geometric four-bar relationship between the main pivot pin 60, main bracket pin 34, seatback rivet 29, and synchro-tilt pivot pin 31 causes the angle formed between the top plate 50 and the backrest 12 to increase from angle A2 in the neutral position of FIG. 8 to angle A4 in the reclined position of FIG. 10.

Similarly, when the chair is forward tilted from the neutral position, the top plate 50 tilts about housing pivot pin 60. The geometric four-bar relationship between the main pivot pin 60, main bracket pin 34, seatback rivet 29, and synchro-tilt pivot pin 31 causes the angle formed between the top plate 50 and the backrest to increase from angle A2 in the neutral position of FIG. 8 to angle A3 in the forward tilt position of FIG. 9.

Tables I–III below present the angular data obtained from a chair having the dual-ratio synchro-tilt feature of the present invention. FIG. 23 graphically presents the data of Tables I–III. The tables and graphs all demonstrate the increase in the angle between the top plate of the chair and the backrest when the chair is reclined or forward tilted from the neutral position. Variance of the data for angles between the backrest and top plate in Tables I–III is the result of the angle between the backrest 12 and the top plate 50 being adjusted between nominal, minimum, and maximum angles with the adjustable synchro-tilt feature discussed above with reference to FIGS. 11 and 12.

TABLE I

| Nominal Adjustable Synchro Angles | |
|---|---|
| Top Plate Angle from Horizontal (Degrees) | Nominal Angle Between Backrest and Top Plate (Degrees) |
| 12 | 104.00 |
| 11 | 101.32 |
| 10 | 99.10 |
| 9 | 97.34 |
| 8 | 96.02 |
| 7 | 95.11 |
| 6 | 94.58 |
| 5 | 94.41 |
| 4 | 94.56 |
| 3 | 95.00 |
| 2 | 95.71 |
| 1 | 96.68 |
| 0 | 97.87 |
| −1 | 99.29 |

TABLE I-continued

| Nominal Adjustable Synchro Angles | |
|---|---|
| Top Plate Angle from Horizontal (Degrees) | Nominal Angle Between Backrest and Top Plate (Degrees) |
| −2 | 100.92 |
| −3 | 102.75 |

The examplary angular data of Table I above was collected when the angle between the top plate 50 the backrest 12 was held in position by the adjustable synchro-tilt feature described above at about 95 degrees and the top plate 50 was in its neutral position, or about 3 degrees reclined from horizontal as depicted in FIG. 8. When manipulating the chair in this configuration, the angle between the backrest and top plate is referred to as the "nominal adjustable synchro angle." As can be seen in Table I, when the top plate is reclined from its neutral position of about 3 degrees to about 12 degrees, the nominal adjustable synchro angle between the backrest and the top plate increases from about 95 degrees to about 104 degrees. This tabular data is conceptually represented in comparing the configuration of FIG. 8 to the configuration of FIG. 10. As generally depicted, the angle A2 of FIG. 8 increases to angle A4 of FIG. 10.

As further represented in Table I, when the top plate is forward tilted from a neutral position of about 3 degrees to about 3 degrees inclined to the horizontal (−3 in Table I), the nominal adjustable synchro angle between the top plate increases from about 95 degrees to about 103 degrees. This tabular data is conceptually represented in comparing the configuration of FIG. 8 to the configuration of FIG 9. As generally depicted, the angle A2 of FIG. 8 increases to angle A3 of FIG, 9.

TABLE II

| Maximum Adjustable Synchro Angles | |
|---|---|
| Top Plate Angle from Horizontal (Degrees) | Maximum Angle Between Backrest and Top Plate (Degrees) |
| 9 | 108.93 |
| 8 | 107.33 |
| 7 | 106.13 |
| 6 | 105.31 |
| 5 | 104.86 |
| 4 | 104.74 |
| 3 | 104.90 |
| 2 | 105.43 |
| 1 | 106.21 |
| 0 | 107.25 |
| −1 | 108.55 |

The examplary angular date of Table II was collected when the angle between the top plate 50 and the backrest 12 was held in position by the adjustable synchro tilt feature described above at about 105 degrees when the top plate 50 is in the neutral position, or about 3 degrees reclined from horizontal as generally depicted in FIG. 11. When manipulating the chair in this configuration, the angle between the backrest and the top plate is referred to as the "maximum adjustable synchro angle." In the configuration generally depicted in FIG. 11, the adjustable synchro-tilt feature more particularly, the rack assembly 36, is shortened to length D.

As can be seen in Table II, when the top plate is reclined from its neutral position of about 3 degrees to about 9 degrees, the maximum adjustable synchro angle between the backrest and the top plate increases from about 105 degrees to about 109 degrees. Notably, with reference to FIG. 11, because the maximum adjustable synchro angle A5 is so obtuse when the top plate is in the neutral position, the geometric configuration of the chair of the preferred embodiment does not allow the top plate to recline from horizontal past about 9 degrees, as indicated in Table II. It will be appreciated that alteration of the chair configuration may allow the top plate to recline to at least 30 degrees from horizontal.

The data of Table II is conceptually represented in comparing the configuration of FIG. 11 to the configuration of FIG. 10. As generally depicted, the maximum adjustable synchro angle A5 of FIG. 11 increases to angle A4 of FIG. 10. Notably, the angle between the top plate 50 and horizontal would be about 9 degrees instead of 12 degrees as depicted. Further, angle A4 of FIG. 10 would be more obtuse than as depicted. Nevertheless, the concept of maximum adjustable synchro angle A5 of FIG. 11 increasing to angle A4 of FIG. 12 is generally illustrated.

As further represented in Table II, when the top plate is forward tilted from a neutral position of about 3 degrees to about 1 degree incline from the horizontal (−1 in Table I), the maximum adjustable synchro angle between the top plate increases from about 105 degrees to about 109 degrees. Because of the maximized configuration of the adjustable synchro-tilt feature, the top plate does not incline from the horizontal greater than 1 degree; however, as will be appreciated by those skilled in the art, modification may be made to the configuration to allow the top plate angle from horizontal to increase to about 20 degrees.

the data of Table II is conceptually represented in comparing the configuration of FIG. 11 to the configuration of FIG. 9. As generally depicted, the maximum adjustable synchro angle A5 of FIG 11 increases to angle A4 of FIG. 9. Notably, the angle between the top plate and horizontal would be about 1 degree instead of 3 degrees as depicted. Further, angle A4 of FIG. 9 would be more pbtuse than as depicted. Nevertheless, the concept of the maximum adjustable synchro angle A5 of FIG. 11 increasing to angle A4 of FIG. 12 is generally illustrated.

TABLE III

| Minimum Adjustable Synchro Angles | |
|---|---|
| Top Plate Angle from Horizontal (Degrees) | Minimum Angle Between Backrest and Top Plate (Degrees) |
| 12 | 99.60 |
| 11 | 97.00 |
| 10 | 94.87 |
| 9 | 93.22 |
| 8 | 92.01 |
| 7 | 91.22 |
| 6 | 90.81 |
| 5 | 90.75 |
| 4 | 91.01 |
| 3 | 91.55 |
| 2 | 32.36 |
| 1 | 93.40 |

TABLE III-continued

| Minimum Adjustable Synchro Angles | |
|---|---|
| Top Plate Angle from Horizontal (Degrees) | Minimum Angle Between Backrest and Top Plate (Degrees) |
| 0 | 94.67 |
| −1 | 96.15 |
| −2 | 97.82 |
| −3 | 99.69 |

The exemplary angular data of Table III was collected when the angle between a top plate 50 and the backrest 12 was held in position by the adjustable synchro-tilt feature described above at about 90 degrees when the top plate 50 is in the neutral position, or about 3 degrees reclined from horizontal as depicted in FIG. 12. When manipulating the chair in this configuration, the angle between the backrest and top plate is referred to as the "minimum adjustable synchro angle." In this configuration, generally depicted in FIG. 12, the adjustable synchro-tilt features, more particularly, the rack assembly 36 is lengthened to length D. As can be seen in Table III when the top plate is reclined from its neutral position of about 3 degrees to about 12 degrees, the minimum adjustable synchro angle between the backrest and the top plate increases from about 92 degrees to about 100 degrees. This tabular data is conceptually represented in comparing the configuration of FIG. 12 to the configuration of FIG. 10. As generally depicted, the minimum adjustable synchro angle A6 of FIG. 12 increases to angle A4 of FIG. 10. Notably, the angle A4 of FIG. 10 would be less obtuse than as depicted.

As further represented in Table III when the top plate is forward tilted from a neutral position of about 3 degrees to about 3 degrees inclined from the horizontal (−3 in Table III), the minimum adjustable synchro angle between a top plate increases from about 92 degrees to about 100 degrees. This tabular data is conceptually represented in comparing the configuration of FIG. 12 to the configuration of FIG. 9. As depicted, the minimum adjustable synchro angle A6 of FIG. 12 increases to angle A4 of FIG. 10.

The data of Tables I–III is graphically represented in FIG. 23. The Y-axis represents the angle between the backrest and the top plate, that is, the adjustable synchro angles. The X-axis represents the angle of the top plate from the horizontal. The nominal adjustable synchro angles of Table I, maximum adjustable synchro angles of Table II, and minimum adjustable synchro angles of Table III are all plotted in relation to the angle of the top plate from the horizontal in the graph.

As can be seen in the graph of FIG. 23, the angle between the backrest and the top plate increases when the angle of the top plate from horizontal is reclined or forward tilted from a neutral position of about 3 to about 5 degrees. Accordingly, the chair "opens up" when the user reclines or forward tilts in the chair. Thus, the user is never pinched between the seat and the backrest. As will be appreciated by those skilled in the art, the configuration of the chair may be altered so that the nominal, maximum, and minimum adjustable synchro angles are of any desired angle.

Chair Height Adjustment

With reference to FIG. 24, the chair of the present invention includes a height adjustment mechanism to alter the distance between the housing from the floor. A conventional pneumatic height adjust is included in the base 20 of the chair. A plunger 132 is disposed at the top of the pneumatic base 20. Height adjust bracket 122 is pivotally mounted to the housing 30 by front pin 134. Height adjust spring 126 biases the height adjust bracket 122 so that the bracket is disengaged from the plunger 132. Height adjust shaft 128 is fixedly attached to height adjust cam 124. A height adjust lever 100 is also attached to the height adjust shaft 128 so that rotation of the height adjust lever 138 will consequently result in rotation of the height adjust cam 124.

To adjust the distance between the housing 30 and the floor, the height adjustment mechanism of the present invention illustrated in FIG. 24 is activated. A user may rotate the lever 138 in either a counterclockwise or clockwise manner. Consequently cam 124 is rotated in either direction as well. Height adjust cam 124 engages the height adjust bracket 122 so that the height adjust bracket 122 rotates counterclockwise about the front pin 34. The user must exert enough rotational force to overcome the height adjust spring 126. Consequently, the height adjust bracket engages the plunger 132 of pneumatic base 20 to expel air from or take air into the pneumatic base 20. As is known in the art, the user may adjust his or her weight to lower or raise the housing with respect to the floor.

Backrest

With reference to FIG. 25, the chair of the present invention includes a backrest height adjustment mechanism. Backrest bracket 13 is pivotally coupled to the top plate 50 by main backrest bracket pin 34. The backrest bracket 13 is be pivotally connected to a rack assembly 36 at seatback rivet 29. A backrest sleeve 176 couples to backrest bracket 13. Backrest plate 178 is slidably received in sleeve 176. Backrest height adjust shaft 172 is rotatably disposed through the backrest bracket 13. The backrest height adjust lever 170 is operably connected to the backrest height adjust cam. Ball 174 is disposed within ball sleeve 175. Cam lobe 173 is engagable against the ball 174 so that the ball will engage the backrest plate 178 and prevent the backrest plate from adjusting vertically. Backrest spring 177 engages top plate 50 and backrest height adjust shaft 172 so that the backrest bracket 13 tends to rotate about main bracket pin 34 in a clockwise manner.

With reference to FIG. 25, vertical adjustment of the backrest 12 will now be described. In an engaged position, the cam lobe 173 is forcibly engaged against ball 174 which consequently is forced against backrest plate 178. This force is sufficient to prevent backrest plate 178 from sliding within sleeve 176 and consequently adjusting the height of the backrest 12 with respect to the backrest bracket 13.

To adjust the height of the backrest with relation to the backrest bracket, a user must rotate the backrest lever 170 in a counterclockwise or clockwise manner. As a consequence of this rotation, the cam lobe 173 rotates and disengages from the ball 174. Consequently, the ball 174 disengages from the backrest plate 178. Accordingly, the backrest plate 178 may slide vertically within a sleeve 176. The user may adjust the backrest 12 upward by manually lifting the backrest 12 upward. Downward displacement of the backrest 12 is motivated by gravity.

Once the user obtains a desired backrest height, the user rotates the lever in a direction opposite from which she originally rotated the lever to re-engage the cam lobe 173 against the ball and consequently the ball against the backrest plate. This will effectively lock the backrest plate into engagement with the ball and the sleeve 176 so that the backrest 12 remains in this vertical position.

The backrest spring 177 of FIG. 25 also aids in returning the backrest to a predetermined angle with respect to the top plate 50. For example, when a user disengages the rack assembly 36 so that the rack 38 is free to extend or retract from the body 40 as described above, the backrest will tend to tilt toward the top plate 50, that is, forward, due to biasing forces exerted on the cam shaft 172. The spring naturally rotates the backrest bracket 13 clockwise about main backrest bracket pin 34. Accordingly, the angle between the backrest 12 and the top plate 50 will be reduced when the rack assembly 36 is disengaged and the user does not exert any rearward force against the backrest 12. However, the backrest spring 177 may be overcome by force exerted on the backrest by a user so that the angle between the backrest 12 and the top plate 50 is increased when the rack assembly 36 is disengaged. Once the user attains a desired angle between the backrest 12 and the top plate 50 he or she may re-engage the rack assembly 36 into a locked mode.

Tilt adjust Mechanism

With reference to FIGS. 26 and 27 the tilt adjust mechanism located in housing 30 will now be described. The tilt adjust mechanism generally includes height adjustment tray 166, spring 168, and tilt adjust rack assembly 136. The height adjustment tray 166 pivotally mounted to the housing 30 via front pin 134. Tension spring 168 is coupled on one end to the spring adjustment tray 166 and on the other end to top plate 50 in a conventional manner. Elastomer 169 is placed within or around the spring 168 to provide dampening. It will be appreciated that any other biasing element may be substituted for the spring 168. Further, any conventional elastomer or dampening material may be used in place of or in combination with elastomer 169.

The rearmost portion of the spring adjust tray 166 defines cross pin slots 162. Within the cross-pin slots is a tension cross pin 160. The cross pin 160 is threaded onto tension cross pin bolt 164. Tension cross pin bolt 164 is itself attached to housing 30 in any manner appreciated by those skilled in the art. Tension cross pin bolt 164 also has secured thereto a conventional tension driven gear 156. Tension drive gear 154 drives tension driven gear 156. Tension drive gear 154 is attached to tilt adjust shaft 152 so that the tension drive gear does not rotate relative to the shaft 152. Tilt adjustment shaft 152 has tilt adjustment knob 150 disposed at an end thereof.

Synchro angle pull sleeve 70 is concentrically disposed about the tilt adjust shaft 152. The synchro angle pull sleeve 70 is slidable in relation to the tilt adjust shaft 152. The synchro angle pull sleeve 70 has cable 46 coupled thereto in a conventional manner at synchro angle pull sleeve tab 72. The cable 46 is operably attached to rack assembly 36 described above. The cable 46 may be guided within the housing with cable guides (not shown) as desired. The cable is disposed through the port 74 and under the bottom of the housing 30 to the cable inlet 47 of the rack assembly 36.

The tilt adjust mechanism illustrated in FIGS. 26 and 27 also includes a tilt adjust rack assembly 236 which is identical to and operates in the same manner as the rack assembly 36. The tilt adjust rack assembly 236 is connected to the front pin 134 and the top plate pin 135 to provide adjustment in the angle of the top plate from horizontal. When in an engaged mode, the tilt adjust rack assembly 236 prevents the top plate from tilting.

The rack assembly 236 is actuatable by tilt adjuster pull sleeve 110 which is circumferentially disposed about the height adjust shaft 128. Cable 246 is connected in a conventional manner at one end to the top plate rack assembly 236 and at the other end to the top plate adjustable pull sleeve tab 272. The cable 246 may be guided by cable guides (not shown) to fit within the housing as desired. As will be appreciated by those skilled in the art, the remote pull sleeve actuators 70 and 110 for the rack assemblies 36 and 236 may be replaced with any conventional remote cable actuating mechanism.

The operation of the tilt adjust mechanism illustrated in FIGS. 26 and 27 will now be described. The force required to tilt the top plate 50 in relation to the housing 30 about housing pivot pin 60, that is, the tilt tension, may be selected by adjusting the compression of the spring 168 and elastomer 169. For example, if the user desires that more force be required to tilt back in her chair, the spring 168 must be preloaded with compressive force. Alternatively, if the user desires that top plate 50 recline quickly from the horizontal, the spring 168 and elastomer must be unloaded.

With reference to FIGS. 26 and 27, the user may adjust the pre-load, or compression, of the spring 168 and elastomer 169 by rotating the tilt adjust knob 150. To increase the compression in the spring and elastomer 168 and 169 and the force required to recline in the chair, the user rotates the knob in a clockwise manner. This rotates tilt adjustment shaft 152 and the attached drive gear 154. Drive gear 154 drives driven gear 156 which rotates cross pin screw 164. Rotation of cross pin screw 164 urges rotation of the cross pin 160. However, because the cross pin 160 is retained within cross pin slots 162 of the spring adjust tray 166, the cross pin 160 does not rotate; rather it effectively threads onto the cross pin screw 164. Consequently, the cross pin 160 is urged toward the driven gear 156.

Because of its coupling to the cross pin 160 at the cross pin slots 162, the spring adjust tray 166 is urged to rotate counterclockwise about front pin 134. In turn, the front portion of 165 of the spring adjust tray 166 moves upward. The spring 168 and elastomer 169 are compressed between the front portion 165 of the spring adjust tray 166 and the top plate 50. Accordingly, the compression of the spring 168 and elastomer 169 is increased. Moreover, when the top plate rack assembly 236 is disengaged as discussed below by pulling the tension pull sleeve 110, more force is required to rotate the top plate 50 about the housing pivot pin 60 and recline or tilt in the chair.

To reduce the amount the spring 168 and elastomer 169 are compressed so that the chair may be reclined from horizontal with ease, the user may rotate the tilt adjustment knob counterclockwise. Upon rotation, the drive gear 154, driven gear 156, and cross pin screw 164 rotate. Consequently, the cross pin 160 is urged to rotate; however, because it is restricted from rotation by cross pin slots 162, the cross pin 160 threads off of the pin screw 164. Accordingly, the cross pin 160 engages the cross pin slots 162 and rotates the spring adjustment tray 166 clockwise about front pin 134. In this manner, the front portion 165 of the spring adjustment tray 166 rotates clockwise. This increases the distance between the top plate 50 and the spring adjustment tray 166. Accordingly, the compression in the spring 168 and elastomer 169 is reduced.

With the compression reduced, the top plate may rotate about housing pivot pin 60 with minimal effort. Moreover, when the tilt rack assembly 236 is disengaged, as discussed below, the chair may be reclined from horizontal with minimal effort.

As will be appreciated by those skilled in the art, the directions of rotation of any of the tilt adjustment mechanisms including all gears, trays, etc. may be reversed. Other mechanisms may also be substituted for those of the preferred embodiment to increase or decrease the force required to recline or tilt the chair.

The operation of the tilt rack assembly will now be described. In its engaged mode, the rack assembly 236 prevents top plate 50 from rotating about housing pivot pin 60. Accordingly, the top plate 50 cannot recline or forward tilt. The tilt rack assembly 236 may be disengaged to allow the top plate 50 to rotate in relation to the housing 30 about housing pivot pin 60. To disengage the tilt rack assembly 236, a user must pull sleeve 110 outward from the housing 30 as indicated in broken lines. The functioning of the rack assembly 236 is identical to that of the rack assembly 36 described above; the user pulls the pull sleeve 104 until the rack is disengaged and rack 238 is free to extend or retract from the rack body 240. Accordingly, the weight of the user seated in the seat coupled to the top plate 50 compresses the spring 168 and elastomer 169. Simultaneously, the top plate 50 may rotate in relation to the housing 30 about housing pivot pin 60.

With the tilt rack assembly in a disengaged mode, the user may lean back in the chair so that the top plate 50 reclines a predetermined angle. Alternatively, the user may remove her weight from the top plate 50, that is, the seat (not shown), so that the spring 168 and elastomer 169 pushes the top plate 50 in a clockwise manner about housing pivot pin 60 to a forward tilted position.

The user may select the angle at which she prefers the top plate 50 to be in relation to the horizontal and lock the top plate into that position by re-engaging the tilt tension rack assembly 236. Re-engagement is actuated by pulling a second time on the pull sleeve 110. As in the above description of the operation of rack assembly 36, the top plate rack assembly will re-engage so that the rack 238 is no longer free to extend and retract from the rack body 240. Thus, the top plate 50 is in fixed relation to the housing 30 and may no longer rotate about housing pivot pin 60.

Alternatively, the user may leave the tilt adjust rack assembly 236 in a disengaged mode, so that the top plate 50 may recline and tilt freely. The user may also use the tilt adjust rack assembly to adjust the pre-load or compression of the spring and elastomer as discussed above. It will be appreciated that other actuators may be substituted for the tilt adjust rack assembly to control the reclination or tilt of the top plate.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

What is claimed is:

1. A tilt control for a chair comprising:

a housing, including a synchro-tilt pivot point;

a top plate pivotally connected to said housing at a main pivot point, said top plate including an articulating pivot point;

a backrest bracket pivotally connected to said top plate at a backrest pivot point, said back rest bracket including a connector pivot point; and a connector including a first end and a second end, said first end pivotally coupled to said connector pivot point, said second end pivotally coupled to one of said synchro-tilt pivot point and said articulating pivot point, whereby coupling of said second end to said synchro-tilt pivot point enables the chair to tilt in a synchro-tilt mode, and coupling of said second end to said articulating pivot point allows the chair to tilt in an articulating mode.

2. The tilt control of claim 1 further including a backrest coupled to said backrest bracket.

3. The tilt control of claim 2 further including a seat mounted to said housing, whereby an angle is formed between said seat and said backrest.

4. The tilt control of claim 3 wherein said second end is separated from said first end by a distance, said distance capable of being increased or decreased.

5. The tilt control of claim 4 wherein increasing said distance while said second end is coupled to said synchro-tilt pivot point results in said angle between said seat and said backrest decreasing.

6. The tilt control of claim 5 wherein decreasing said distance while said second end is coupled to said synchro-tilt pivot causes said angle between said seat and said backrest to increase.

7. The tilt control of claim 6 wherein said angle between said seat and said backrest translatable to configurations chosen from reclined, neutral, and forward tilt.

8. The tilt control of claim 7 wherein a seat angle is formed between said seat and a horizontal plane.

9. The tilt control of claim 8 wherein said angle formed between said seat and said backrest increases and said seat angle increases when said backrest and said seat translate from said neutral position to said reclined position in said synchro-tilt mode.

10. The tilt control of claim 9 wherein said angle formed between said seat and said backrest increases when said seat and said backrest translate from a neutral to a forward tilt position in said synchro-tilt mode.

11. The tilt control of claim 10 wherein said angle formed between said seat and said backrest remains constant when said seat and said backrest are translated from said neutral to said recline position in said articulating mode.

12. The tilt control of claim 11 wherein said angle between said seat and said backrest remains the same when said seat and said backrest are translated from said neutral position to said forward tilt position in said articulating mode.

13. The tilt control of claim 12 wherein said connector is remotely actuatable.

14. The tilt control of claim 13 wherein said connector is a remotely actuatable pawl tooth rack assembly.

15. A tilt control for a chair comprising:

a housing;

a seat pivotally connected to said housing;

a backrest coupled to said seat; and a connector coupled to said backrest and one of said seat and said housing whereby said tilt control attains an articulating mode when said connector is coupled to said seat and a synchronized tilt mode when said connector is coupled to said housing.

16. The tilt control of claim 15 wherein said connector includes first and second ends and means for adjusting the distance between said first and second ends.

17. The chair tilt control of claim 16 wherein lengthening said connector decreases an angle formed between said backrest and said seat.

18. The chair tilt control of claim 17 wherein shortening of the connector increases said angle formed between said backrest and said seat.

19. A chair control comprising:

seat means for supporting a chair seat;

back means for supporting a chair back;

recliner means for enabling said seat means to move through a plurality of positions between and including an upright position and a reclined position; and interconnect means for interconnecting said back means and said seat means in either a fixed mode or a synchro-tilt mode, the angle between said back means and said seat means in the fixed mode being the same for all positions of the seat means, the angle between said back means and said seat means in the synchro-tilt mode being different for different positions of the seat means.

20. The chair control of claim 19 further comprising adjusting means for altering the angle between the seat means and the back means.

21. The chair control of claim 20 wherein said adjusting means is remotely actuatable.

22. A chair control comprising:

a housing, a top plate coupled to said housing, a first mode wherein said top plate is movable between a normal position, a reclined position and a forward tilted position;

a preventing mode including preventing means for selectively preventing the forward tilt of said top plate from the normal position to the forward tilted position, said preventing means also permitting said top plate to recline from the normal position to the reclined position when in said first mode; and an actuator selectively connected to said preventing means.

23. The chair control of claim 22, wherein said preventing mode is adjustable to an enabled mode and a disabled mode.

24. The chair control of claim 23 wherein said preventing means is a cam rotatable between at least first and second positions.

25. The chair control of claim 24 wherein said top plate includes a projection adapted for engaging said preventing means.

26. The chair control of claim 25 wherein said cam engages said projection when said cam is rotated to said first position whereby forward tilt of the chair is prevented.

27. The chair control of claim 26 wherein said cam is incapable of engaging said projection when said cam is in said second position whereby said top plate is translatable to a forward tilt position.

28. The chair control of claim 27 wherein said cam defines a hole for receiving a forward tilt lever that allows the user to rotate the cam to a desired position.

29. A chair control comprising:

a seat support;

recliner means for enabling said seat support to move through a plurality of positions including a forward-tilt position, a reclined position, and an upright position between the forward-tilt position and the reclined position;

a lock manually operable between a forward-tilt mode and a locked mode, said lock when in the forward-tilt mode permitting movement of said seat support from the upright position to the forward-tilt position, said lock when in the locked mode preventing movement of said seat support between the upright position and the forward-tilt position and permitting movement of said seat support between the upright position and the reclined position; and an actuator selectively installable in the lock.

30. The chair control of claim 29 wherein said lock includes a cam.

31. The chair control of claim 29 wherein the chair control is adapted to be supplied to users with or without the lock installed.

32. A forward tilt control for a chair comprising:

a housing;

a plate pivotally coupled to said housing whereby said plate may tilt with respect to the housing;

a cam including a first surface and a second surface, said cam rotatably mounted to one of said housing and said top plate; and a protrusion projecting from one of said housing and said plate, said protrusion capable of traveling in a path, said protrusion capable of engaging said first surface to prevent said plate from tilting in a forward direction.

33. The forward tilt control of claim 32 when said plate is capable of tilting in a forward direction at a predetermined angle when said second surface is positioned in said path of travel of said protrusion.

34. The forward tilt control of claim 32 wherein said cam is rotatably mounted to said top plate and said protrusion projects from said housing.

35. The forward tilt control of claim 32 wherein said cam is rotatably mounted to said housing and said protrusion projects from said top plate.

36. The forward tilt control of claim 35 wherein said cam defines a hole engagable by an actuator.

37. The forward tilt control of claim 36 wherein said actuator is provided to a consumer of a forward tilt control whereby the consumer may couple the actuator to the cam so that the forward tilt is activated.

38. The forward tilt control of claim 37 wherein said actuator is a lever shaft insertable into said hole defined by said cam.

39. A chair comprising:

a housing defining a forward tilt access port;

a seat support pivotally secured to said housing and adapted to forward tilt and recline from a normal position;

backrest means for supporting a backrest secured to at least one of said housing and said seat support and adapted to forward tilt and recline from the normal position;

chair control means for both selectively preventing the forward tilting of said seat support and said backrest means from said normal position, and permitting reclining of said seat support and said backrest means in a locked mode, and permitting the forward tilting of said seat support and said backrest means from said normal position in an unlocked mode, said chair control means including a rotatable selector defining a selector port aligned with said forward tilt access port, said selector having positions corresponding to at least one of the locked and unlocked modes; and an actuator selectively installable through said forward tilt access port and keyed with said selector port, said actuator when installed enabling a user to rotate said selector.

40. A forward tilt mechanism comprising:

a seat support;

a forward tilt activator coupled to said seat support, said activator engagable between an enabled mode and a disabled mode whereby when said activator is in said enabled mode, the seat support is selectively forward tiltable, when said activator is in said disabled mode the seat support is prevented from forward tilting but is permitted to recline; and an actuator selectively connected to said forward tilt activator so that rotation of said actuator results in movement of said forward tilt activator between the enabled and disabled modes.

41. A dual-ratio synchro-tilt chair control comprising:

a seat; and a backrest pivotally coupled to said seat, said seat and said backrest forming an angle therebetween, said seat and said backrest tiltable in concert from an upright position to a forward tilt position whereby said angle increases in transition from said upright position to said forward tilt position.

42. The dual-ratio synchro-tilt chair control of claim 41 wherein said seat and said backrest are tiltable in concert from said upright position to a reclined position.

43. The dual-ratio synchro-tilt chair control of claim 42 wherein tilting of said seat and said backrest from said upright position to said reclined position results in said angle increasing.

44. The dual-ratio synchro-tilt chair control of claim 43 further comprising a housing, said seat and said backrest pivotally coupled to said housing.

45. The dual-ratio synchro-tilt chair control of claim 44 wherein said backrest is pivotally coupled to said seat and a connector, said connector pivotally coupled to said housing.

46. A synchro-tilt chair comprising:

a base;

a top plate pivotally mounted to said base, said top plate forming a first angle with respect to horizontal;

a backrest pivotally coupled to said top plate and said top plate and said backrest forming a second angle therebetween, said backrest tiltable in concert with said top plate from a neutral position to a forward tilt position whereby said second angle increases; and a member pivotally coupling said backrest to said base.

47. The synchro-tilt chair of claim 46 wherein said backrest and said seat are reclinable from said neutral position whereby said second angle increases.

48. The synchro-tilt chair of claim 47 wherein said member is adjustable in length whereby said second angle may be either increased or decreased.

49. The synchro-tilt chair of claim 48 wherein said second angle increases at a rate greater than a rate of change of said first angle when said backrest and said seat recline from said neutral position.

50. The synchro-tilt chair of claim 49 wherein said second angle increases at a rate greater than the rate of change of the said first angle when said backrest and said seat tilt from said neutral position to said forward tilt position.

51. The synchro-tilt chair of claim 50 further comprising an actuator assembly capable of adjusting said first angle.

52. A chair control comprising:

seat means for supporting a chair seat;

back means for supporting a chair back; and recliner means enabling said seat means to move through a plurality of positions including a forward-tilt position, a reclined position, and an upright position between the forward-tilt position and the reclined position; and synchro-tilt means for controlling the angle between said back means and said seat means so that the angle increases when the seat means and back means are moved in a synchronized manner from the upright position toward the forward-tilt position.

53. A chair comprising:

a seat;

a backrest coupled to said seat in an angular relation, said seat and backrest tiltable in a synchronized tilting manner from an upright position to a reclined position so that the angular relation changes with the extent of tilting; and adjusting means for adjusting the angular relation between said seat and said backrest in both the upright position and the reclined position together.

54. A chair comprising:

a seat support movable among a plurality of positions including a forward-tilt position, an upright position, and a reclined position;

a chair control coupled to said seat support and selectively configurable in a locked mode wherein said seat support is prevented from moving to said forward-tilt position from said upright position, and is permitted to move from said upright position to said reclined position, said chair control including a forward tilt activator; and an actuator shaft selectively installable in said chair control and selectively coupled to said forward tilt activator so that movement of said actuator shaft moves said forward tilt activator, said actuator shaft being accessible and manually operable by a chair occupant.

55. A dual-ratio synchro-tilt control chair comprising:

a seat support;

control means for permitting said seat support to tilt between a normal position and a forward tilt position; and a back support supported by said control means so that the angle between said back support and said seat support change during tilting of the said seat support, the angle in the forward tilt position being greater than the angle in the normal position.

* * * * *